US011517902B2

(12) United States Patent
Walton et al.

(10) Patent No.: US 11,517,902 B2
(45) Date of Patent: Dec. 6, 2022

(54) MICROFLUIDIC DEVICE AND A METHOD OF LOADING FLUID THEREIN

(71) Applicant: Sharp Life Science (EU) Limited, Oxford (GB)

(72) Inventors: Emma Jayne Walton, Oxford (GB); Lesley Anne Parry-Jones, Oxford (GB)

(73) Assignee: Sharp Life Science (EU) Limited, Uxbridge (GB)

( * ) Notice: Subject to any disclaimer, the term of this patent is extended or adjusted under 35 U.S.C. 154(b) by 404 days.

(21) Appl. No.: 16/562,612

(22) Filed: Sep. 6, 2019

(65) Prior Publication Data

US 2020/0269249 A1 Aug. 27, 2020

(30) Foreign Application Priority Data

Sep. 12, 2018 (EP) ..... 18194096

(51) Int. Cl.
*B01L 3/00* (2006.01)

(52) U.S. Cl.
CPC ... *B01L 3/502792* (2013.01); *B01L 3/502715* (2013.01); *B01L 2200/027* (2013.01);
(Continued)

(58) Field of Classification Search
CPC ..... B01L 2200/0642; B01L 2200/0605; B01L 2300/089; B01L 2300/0816;
(Continued)

(56) References Cited

U.S. PATENT DOCUMENTS 5,096,669 A 3/1992 Lauks et al.
6,565,727 B1 5/2003 Shenderov
(Continued)

FOREIGN PATENT DOCUMENTS

EP 2404675 1/2012
EP 2606975 6/2013
(Continued)

OTHER PUBLICATIONS

Fair, R.B., "Digital microfluids: is a true lab-on-a-chip possible?" Microfluidics and Nanofluidics Jun. 2007, vol. 3, Issue 3, pp. 245-281.

*Primary Examiner* — Shogo Sasaki
(74) *Attorney, Agent, or Firm* — Renner, Otto, Boisselle & Sklar, LLP

(57) ABSTRACT

A microfluidic device comprises upper and lower spaced apart substrates defining a fluid chamber therebetween; an aperture for introducing fluid into the fluid chamber; a plurality of independently addressable array elements, each array element defining a respective region of the fluid chamber; and control means for addressing the array elements. The control means are configured to: determine that a working fluid has been introduced into a first region of the fluid chamber; and provide an output to a user to indicate that the working fluid is present in the first region.

Once the working fluid is in the first region, the fluid applicator used to dispense the fluid can be removed without any risk of accidentally withdrawing dispensed working fluid from the microfluidic device. In the case of manual loading of the working fluid the output may inform a user that it is safe to remove the applicator, or in the case of automatic or robotic loading the output signal may be
(Continued)

provided to the system controlling the automatic or robotic loading of fluid so that the system can remove the fluid applicator.

12 Claims, 11 Drawing Sheets

(52) U.S. Cl.
CPC ..... *B01L 2200/0605* (2013.01); *B01L 2200/0684* (2013.01); *B01L 2200/143* (2013.01); *B01L 2300/089* (2013.01); *B01L 2300/0816* (2013.01); *B01L 2300/0867* (2013.01); *B01L 2400/02* (2013.01); *B01L 2400/0688* (2013.01)

(58) Field of Classification Search
CPC ..... B01L 2300/0867; B01L 3/502792; B01L 2400/02; B01L 2400/0487; B01L 2200/143; B01L 2400/0688; B01L 3/502715; B01L 2200/027; B01L 2400/0427; B01L 2200/0673; B01L 2200/0684
See application file for complete search history.

(56) References Cited

U.S. PATENT DOCUMENTS

| | | | | |
|---|---|---|---|---|
| 6,773,566 | B2 * | 8/2004 | Shenderov | F04B 19/006 204/600 |
| 6,911,132 | B2 | 6/2005 | Pamula et al. | |
| 6,958,132 | B2 * | 10/2005 | Chiou | F04B 19/006 204/600 |
| 6,989,234 | B2 * | 1/2006 | Kolar | B01L 3/0241 435/7.1 |
| 7,163,612 | B2 | 1/2007 | Sterling et al. | |
| 7,693,666 | B2 * | 4/2010 | Griffith | B01L 3/502784 702/22 |
| 8,480,974 | B2 * | 7/2013 | Rapp | B01L 3/502738 422/537 |
| 8,594,848 | B2 * | 11/2013 | Ludwig | G01N 35/0092 422/62 |
| 8,653,832 | B2 | 2/2014 | Hadwen et al. | |
| 9,395,329 | B2 * | 7/2016 | Pamula | C12Q 1/6806 |
| 9,494,498 | B2 * | 11/2016 | Pamula | G01N 33/54326 |
| 9,782,775 | B2 * | 10/2017 | Akella | F04B 19/006 |
| 2003/0047688 | A1 * | 3/2003 | Faris | B01L 3/502792 250/432 R |
| 2003/0164295 | A1 * | 9/2003 | Sterling | B01L 3/50273 204/600 |
| 2003/0224528 | A1 * | 12/2003 | Chiou | F04B 19/006 436/164 |
| 2004/0058450 | A1 * | 3/2004 | Pamula | B01L 3/502792 436/52 |
| 2004/0228770 | A1 | 11/2004 | Gandhi et al. | |
| 2004/0231987 | A1 * | 11/2004 | Sterling | F04B 17/00 204/600 |
| 2006/0021875 | A1 * | 2/2006 | Griffith | B01F 35/2209 204/601 |
| 2010/0282608 | A1 | 11/2010 | Srinivasan et al. | |
| 2010/0282609 | A1 | 11/2010 | Pollack et al. | |
| 2013/0161193 | A1 | 6/2013 | Jacobs et al. | |
| 2013/0280725 | A1 | 10/2013 | Ismagilov et al. | |
| 2017/0056887 | A1 | 3/2017 | Hadwen et al. | |
| 2017/0059523 | A1 | 3/2017 | Hawden et al. | |

FOREIGN PATENT DOCUMENTS

| | | |
|---|---|---|
| EP | 3311918 | 4/2018 |
| EP | 3311919 | 4/2018 |
| EP | 3357575 | 8/2018 |
| EP | 3427831 | 1/2019 |
| GB | 2542372 | 3/2017 |
| WO | 0230560 | 4/2002 |
| WO | 03045556 | 6/2003 |
| WO | 2009052095 | 4/2009 |
| WO | 2009086403 | 7/2009 |
| WO | 2014062551 | 4/2014 |
| WO | 2017/047082 | 3/2017 |

* cited by examiner

¶

→ ¶

MICROFLUIDIC DEVICE AND A METHOD OF LOADING FLUID THEREIN

TECHNICAL FIELD

The present invention relates to a microfluidic device, and to a method for loading fluid into such a device. More particularly, the invention relates to an Active Matrix Electro-wetting on Dielectric (AM-EWOD) microfluidic device. Electro-wetting-On-Dielectric (EWOD) is a known technique for manipulating droplets of fluid on an array. Active Matrix EWOD (AM-EWOD) refers to implementation of EWOD in an active matrix array incorporating transistors, for example by using thin film transistors (TFTs).

BACKGROUND ART

Microfluidics is a rapidly expanding field concerned with the manipulation and precise control of fluids on a small scale, often dealing with sub-microlitre volumes. There is growing interest in its application to chemical or biochemical assay and synthesis, both in research and production, and applied to healthcare diagnostics ("lab-on-a-chip"). In the latter case, the small nature of such devices allows rapid testing at point of need using much smaller clinical sample volumes than for traditional lab-based testing.

A microfluidic device can be identified by the fact that it has one or more channels (or more generally gaps) with at least one dimension less than 1 millimeter (mm). Common fluids used in microfluidic devices include whole blood samples, bacterial cell suspensions, protein or antibody solutions and various buffers. Microfluidic devices can be used to obtain a variety of interesting measurements including molecular diffusion coefficients, fluid viscosity, pH, chemical binding coefficients and enzyme reaction kinetics. Other applications for microfluidic devices include capillary electrophoresis, isoelectric focusing, immunoassays, enzymatic assays, flow cytometry, sample injection of proteins for analysis via mass spectrometry, PCR amplification, DNA analysis, cell manipulation, cell separation, cell patterning and chemical gradient formation. Many of these applications have utility for clinical diagnostics.

Many techniques are known for the manipulation of fluids on the sub-millimetre scale, characterised principally by laminar flow and dominance of surface forces over bulk forces. Most fall into the category of continuous flow systems, often employing cumbersome external pipework and pumps. Systems employing discrete droplets instead have the advantage of greater flexibility of function.

Electro-wetting on dielectric (EWOD) is a well-known technique for manipulating discrete droplets of fluid by application of an electric field. It is thus a candidate technology for microfluidics for lab-on-a-chip technology. An introduction to the basic principles of the technology can be found in "Digital microfluidics: is a true lab-on-a-chip possible?" (R. B. Fair, Microfluid Nanofluid (2007) 3:245-281).

FIG. 1 shows a part of a conventional EWOD device in cross section. The device includes a lower substrate 10, the uppermost layer of which is formed from a conductive material which is patterned so that a plurality of array element electrodes 12 (e.g., 12A and 12B in FIG. 1) are realized. The electrode of a given array element may be termed the element electrode 12. A liquid droplet 14, including a polar material (which is commonly also aqueous and/or ionic), is constrained in a plane between the lower substrate 10 and a top substrate 16. A suitable gap or channel between the two substrates may be realized by means of a spacer 18, and a nonpolar filler fluid or surround fluid 20 (e.g. an oil such as a silicone oil) may be used to occupy the volume not occupied by the liquid droplet 14. The function of the filler fluid is to reduce the surface tension at the surfaces of the polar droplets, and to increase the electro-wetting force, which ultimately leads to the ability to create small droplets and to move them quickly. It is usually beneficial, therefore, for the filler fluid to be present within the channel of the device before any polar fluids are introduced therein. Since the liquid droplet is polar and the filler fluid is non-polar the liquid droplet and the filler fluid are substantially immiscible.

An insulator layer 22 disposed upon the lower substrate 10 separates the conductive element electrodes 12A, 12B from a first hydrophobic coating 24 upon which the liquid droplet 14 sits with a contact angle 26 represented by θ. The hydrophobic coating is formed from a hydrophobic material (commonly, but not necessarily, a fluoropolymer). On the top substrate 16 is a second hydrophobic coating 28 with which the liquid droplet 14 may come into contact. Interposed between the top substrate 16 and the second hydrophobic coating 28 is a reference electrode 30.

The contact angle θ is defined as shown in FIG. 1, and is determined by the balancing of the surface tension components between the solid-to liquid ($\gamma_{SL}$), the liquid-to non-polar surrounding fluid ($\gamma_{LG}$) and the solid to non-polar surrounding fluid ($\gamma_{SG}$) interfaces, and in the case where no voltages are applied satisfies Young's law, the equation being given by:

$$\cos\theta = \frac{\gamma_{SG} - \gamma_{SL}}{\gamma_{LG}} \quad \text{(equation 1)}$$

In operation, voltages termed the EW drive voltages, (e.g. $V_T$, $V_0$ and $V_{00}$ in FIG. 1) may be externally applied to different electrodes (e.g. reference electrode 30, element electrodes 12, 12A and 12B, respectively). The resulting electrical forces that are set up effectively control the hydrophobicity of the hydrophobic coating 24. By arranging for different EW drive voltages (e.g. $V_0$ and $V_{00}$) to be applied to different element electrodes (e.g. 12A and 12B), the liquid droplet 14 may be moved in the lateral plane between the two substrates 10 and 16.

FIG. 2 is a drawing depicting additional details of an exemplary AM-EWOD device 36 in schematic perspective, which may incorporate the layered structures in FIG. 1. The AM-EWOD device 36 has a lower substrate 44 with thin film electronics 46 disposed upon the lower substrate 44, and a reference electrode (not shown, but comparable to reference electrode 30 above) is incorporated into an upper substrate 54. The electrode configuration may be reversed, with the thin film electronics being incorporated into the upper substrate and the reference electrode being incorporated into the lower substrate. The thin film electronics 46 are arranged to drive array element electrodes 48—for example the thin film electronic 46 associated with an array element electrode may comprise one or more thin-film transistors (TFTs) that are controlled by an EWOD control unit (not shown). A plurality of array element electrodes 48 are arranged in an electrode or element array 50, having X by Y array elements where X and Y may be any integer. A liquid droplet 52 which may include any polar liquid and which typically may be aqueous, is enclosed between the lower substrate 44 and the upper substrate 54 separated by a spacer 56, although it will be appreciated that multiple liquid droplets 52 can be present.

As described above with respect to the representative EWOD structure, the EWOD channel or gap defined by the two substrates initially is filled with the nonpolar filler fluid (eg oil). The liquid droplets 14/52 including a polar material, i.e., the droplets to be manipulated by operation of the EWOD device, must be inputted from an external "reservoir" of fluid into the EWOD channel or gap. The external reservoir may for example be a pipette, or may be a structure incorporated into the plastic housing of the device. As the fluid from the reservoir for the droplets is inputted, filler fluid gets displaced and is removed from the EWOD channel.

Example configurations and operation of EWOD devices are described in the following. U.S. Pat. No. 6,911,132 (Pamula et al., issued Jun. 28, 2005) discloses a two dimensional EWOD array to control the position and movement of droplets in two dimensions. U.S. Pat. No. 6,565,727 (Shenderov, issued May 20, 2003) further discloses methods for other droplet operations including the splitting and merging of droplets, and the mixing together of droplets of different materials. U.S. Pat. No. 7,163,612 (Sterling et al., issued Jan. 16, 2007) describes how TFT based thin film electronics may be used to control the addressing of voltage pulses to an EWOD array by using circuit arrangements very similar to those employed in AM display technologies.

The review "Digital microfluidics: is a true lab-on-a-chip possible?", R. B. Fair, Microfluid Nanofluid (2007) 3:245-281) notes that methods for introducing fluids into the EWOD device are not discussed at length in the literature. It should be noted that this technology employs the use of hydrophobic internal surfaces. In general, therefore, it is energetically unfavourable for aqueous fluids to fill into such a device from outside by capillary action alone. Further, this may still be true when a voltage is applied and the device is in an actuated state. Capillary filling of non-polar fluids (e.g. oil) may be energetically favourable due to the lower surface tension at the liquid-solid interface.

A few examples exist of small microfluidic devices where fluid input mechanisms are described. U.S. Pat. No. 5,096,669 (Lauks et al.; published Mar. 17, 1992) shows such a device comprising an entrance hole and inlet channel for sample input coupled with an air bladder which pumps fluid around the device when actuated. It is does not describe how to input discrete droplets of fluid into the system nor does it describe a method of measuring or controlling the inputted volume of such droplets. Such control of input volume (known as "metering") is important in avoiding overloading the device with excess fluid and helps in the accuracy of assays carried out where known volumes or volume ratios are required.

US20100282608 (Srinivasan et al.; published Nov. 11, 2010) describes an EWOD device comprising an upper section of two portions with an aperture through which fluids may enter. It does not describe how fluids may be forced into the device nor does it describe a method of measuring or controlling the inputted volume of such fluids. Related application US20100282609 (Pollack et al.; published Nov. 11, 2010) does describe a piston mechanism for inputting the fluid, but again does not describe a method of measuring or controlling the inputted volume of such fluid.

US20100282609 describes the use of a piston to force fluid onto reservoirs contained in a device already loaded with oil. US20130161193 describes a method to drive fluid onto a device filled with oil by using, for example, a bistable actuator.

GB2542372 and WO 2017/047082 describe a microfluidic AM-EWOD device configured to, when the chamber of the device contains a metered volume of a filler fluid that partially fills the chamber, preferentially maintain the metered volume of the filler fluid in a part of the chamber. FIG. 3 is a schematic plan view of a microfluidic AM-EWOD device of GB 2542372/WO 2017/047082, after a metered volume of filler fluid has been introduced into the fluid chamber. The metered volume of filler fluid does not completely fill the fluid chamber, and the part of the fluid chamber containing filler fluid is shown shaded in FIG. 3. Filler fluid is preferentially maintained in a first region 5 of the fluid chamber by means of a fluid barrier 6, and there exists a second region 7 of the fluid chamber that is not filled with filler fluid and that contains a venting fluid such as air. The device is configured to allow displacement of some of the filler fluid from the part of the chamber when a volume of a working fluid (or assay fluid) 8 is introduced into the part of the chamber containing filler fluid, eg via port 9, thereby causing a volume of the venting fluid to vent from the chamber via a vent 11.

SUMMARY

A first aspect of the present invention provides a microfluidic device comprising: upper and lower spaced apart substrates defining a fluid chamber therebetween; an aperture for introducing fluid into the fluid chamber; and a fluid input structure disposed over the upper substrate and having a fluid well for receiving fluid from a fluid applicator inserted into the fluid well, the fluid well communicating with a fluid exit provided in a base of the fluid input structure, the fluid exit being adjacent the aperture; wherein the fluid well comprises first, second and third portions, the first second and third portions different from one another, the first portion of the well forming a reservoir for a filler fluid; the second portion of the well being configured to sealingly engage against an outer surface of a fluid applicator when the fluid applicator is inserted into the fluid well; and the third portion of the well communicating with the fluid exit and having a diameter at the interface between the third portion and the second portion that is greater than the diameter of the second portion at the interface between the third portion and the second portion. The microfluidic device may be an electrowetting on dielectric (EWOD) microfluidic device, that further comprises a plurality of element electrodes, each element electrode defining a respective element of the EWOD device.

In this aspect, when a fluid applicator is inserted into the fluid well, the part of the fluid applicator from which working fluid is dispensed (this is typically an end of the applicator) touches the surface of, and passes into, the filler fluid in the well before the outer surface of the fluid applicator seals against the second portion of the well. This prevents air from being entrapped in the working fluid dispensed from the applicator and so prevents air from being introduced into the fluid chamber of the microfluidic device. (The term "below" relates to a device oriented as shown in, for example, FIG. 5(*a*) or 5(*b*).)

The second portion of the fluid well may be adjacent to the first portion of the fluid well. Alternatively, the second portion of the fluid well may be spaced to the first portion of the fluid well—for example, if the first portion has a different cross section to the second portion, the first portion may be spaced from the second portion by a "transition" portion in which the cross-section gradually changes from the cross section of the first portion to the cross section of the second portion, to avoid an abrupt change in the cross section of the fluid well.

The aperture may be defined between the upper substrate and the lower substrate.

The aperture may be defined in the upper substrate.

The axial length of the third region of the well may be such that, when the fluid applicator is inserted into the fluid input structure so that the outer surface the fluid applicator sealingly engages against the second portion of the well, an end of the fluid applicator is spaced from the upper and lower substrates.

The fluid input structure may extend around a periphery of the upper substrate.

The device may comprise a plurality of apertures for introducing fluid into the fluid chamber; wherein the fluid input structure comprises a plurality of fluid wells, each fluid well associated with a respective aperture.

A second aspect of the invention provides a method of loading a fluid into a microfluidic device of the first aspect, the method comprising: loading a filler fluid into the microfluidic device such that the filler fluid at least partially fills the first portion of the fluid well; inserting a fluid applicator into the fluid well such that the outer surface of the fluid applicator sealingly engages against the second portion of the fluid well; and dispensing working fluid from the fluid applicator.

In a method of this aspect, the part of the fluid applicator from which working fluid is dispensed (this is typically an end of the applicator, for example a tip of the applicator) is below the surface of the filler fluid in the fluid well when the outer surface of the fluid applicator seals against the second portion of the well (and when the working fluid is subsequently dispensed from the applicator). This prevents air from being entrapped in the dispensed working fluid and so prevents air from being introduced into the fluid chamber of the microfluidic device.

The method may further comprise dispensing a predetermined volume of working fluid from the fluid applicator.

The method may further comprise, after dispensing the working fluid from the fluid applicator into the fluid well, dispensing a second fluid from the fluid applicator.

The dispensed second fluid may remain connected to the fluid applicator.

The second fluid may be a fluid that is different to both the filler fluid and the working fluid. The second fluid may be air.

The method may further comprise actuating at least one element electrode of the microfluidic device to hold the dispensed working fluid in the fluid chamber of the microfluidic device.

The method may further comprise, after actuating the at least one element electrode, extracting the second fluid from the fluid chamber. This may be done by removing the fluid applicator from the well such that any second fluid dispensed from the fluid applicator that entered the microfluidic device is extracted upon removal of the applicator. As an example, if the applicator is a pipette, working fluid is dispensed by pushing the pipette plunger to a first position (such as the "stop" described below) and second fluid has been dispensed by pushing the pipette plunger past the "stop" in the manner described below, retracting the pipette from the well with the plunger held in the 'down' position, in which the pipette plunger is pushed in to its maximum extent or at least is still pushed in beyond the stop, will result in retraction of second fluid from the chamber. If desired, this technique may be applied in combination with one of the techniques described below for moving dispensed working fluid to a "safe" region in the fluid chamber and/or holding moving dispensed working fluid at a "safe" region in the fluid chamber to eliminate (or substantially reduce) the risk of working fluid inadvertently being extracted with the second fluid Alternatively, extracting the second fluid from the fluid chamber may be done before the fluid applicator is retracted. As an example, if the applicator is a pipette, working fluid has been dispensed by pushing the pipette plunger to a first position (such as the "stop" described below) and second fluid has been dispensed by pushing the pipette plunger past the "stop" in the manner described below, leaving the pipette in position and returning the plunger to the stop position (or allowing the plunger to return to the stop position), will result in retraction of second fluid from the chamber. After the plunger has returned/been returned to the "stop" position and the second fluid retracted, the pipette may then be retracted. If desired, this technique may be applied in combination with one of the techniques described below for moving dispensed working fluid to a "safe" region in the fluid chamber and/or holding moving dispensed working fluid at a "safe" region in the fluid chamber, to eliminate (or substantially reduce) the risk of working fluid inadvertently being extracted with the second fluid.

The method may further comprise after actuating the at least one element electrode, extracting a volume of filler fluid from the fluid chamber. In the example where the applicator is a pipette, and second fluid has been dispensed by pushing the pipette plunger past a "stop", allowing the pipette plunger to return to its 'fully out' position before retracting the pipette from the well will result in retraction from the chamber of both second fluid and a volume of filler fluid.

The volume of filler fluid extracted from the fluid chamber may be equal to the volume of working fluid dispensed from the fluid applicator.

The fluid applicator may be a pipette and dispensing fluid from the fluid applicator may comprise pushing a plunger of the pipette to a first position to dispense working fluid and subsequently pushing the plunger beyond the first position to dispense the second fluid, and extracting the second fluid from the fluid chamber may comprise retracting the fluid applicator from the well with the plunger beyond the first position.

The fluid applicator may be a pipette and dispensing fluid from the fluid applicator may comprise pushing a plunger of the pipette to a first position to dispense working fluid and subsequently pushing the plunger beyond the first position to dispense the second fluid, and extracting the second fluid from the fluid chamber may comprise returning the plunger, or allowing the plunger to return, to the first position before retracting the fluid applicator from the well.

The method may further comprise monitoring the area of the region of the fluid chamber in which working fluid is present as the second fluid and/or filler fluid are extracted. If the region in which working fluid is present should decrease in size this would indicate that working fluid has inadvertently been extracted, and an output can be provided to indicate this. In the case of manual fluid loading the output is provided to a user and may for example be an audible and/or visual output, whereas in the case of automated or robotic fluid loading the output is provided to a control unit that is controlling the automated or robotic fluid loading and may for example be an electrical or optical signal.

A third aspect of the invention provides a method of loading a fluid into a microfluidic device, the microfluidic device comprising: upper and lower spaced apart substrates defining a fluid chamber therebetween; an aperture for receiving fluid into the fluid chamber; and a fluid input structure disposed over the upper substrate and having a fluid well for receiving fluid from a fluid applicator inserted into the fluid input structure, the fluid well communicating with a fluid exit provided in a base of the fluid input structure, the fluid exit being adjacent the aperture, the method comprising: loading a filler fluid into the microfluidic device such that the filler fluid at least partially fills the fluid well; inserting a fluid applicator into the fluid well such that the outer surface of an end of the fluid applicator sealingly engages against the fluid well at a position below the surface of the filler fluid; and dispensing working fluid from the fluid applicator into the fluid well.

The method may further comprise dispensing a predetermined volume of working fluid from the fluid applicator.

A fourth aspect of the present invention provides an active matrix electrowetting on dielectric (AM-EWOD) microfluidic device comprising: upper and lower spaced apart substrates defining a fluid chamber therebetween; an aperture for introducing fluid into the fluid chamber; a plurality of independently addressable array elements, each array element defining a respective region of the fluid chamber; and control means for addressing the array elements, the control means configured to: determine by controlling the EWOD array elements to operate in a sensing mode, that a working fluid has been introduced into a first region of the fluid chamber; and provide an output to indicate that the working fluid is present in the first region.

Once the working fluid is in the first region, the fluid applicator used to dispense the fluid can then be removed without any risk of accidentally withdrawing the dispensed working fluid from the microfluidic device. Thus in the case of manual loading of the working fluid the output may inform a user that it is safe to remove the applicator, or in the case of automatic or robotic loading of fluid the output signal may be provided to the system controlling the automatic or robotic loading of fluid so that the system can remove the fluid applicator.

A device of the fourth aspect may further comprise a fluid input structure disposed over the upper substrate and having a fluid well for receiving fluid from a fluid applicator inserted into the fluid well, the fluid well communicating with a fluid exit provided in a base of the fluid input structure, the fluid exit being adjacent the aperture; wherein the fluid well comprises first, second and third portions, the first portion of the well forming a reservoir for a filler fluid; the second portion of the wellbeing configured to sealingly engage against an outer surface of a fluid applicator inserted into the fluid well; and the third portion of the well communicating with the fluid exit and having a diameter at the interface between the third portion and the second portion that is greater than the diameter of the second portion at the interface between the third portion and the second portion In a device of the first or fourth aspect the control means may be configured to actuate a first group of array elements of the microfluidic device, the first group of the array elements corresponding to the first region of the fluid chamber to move working fluid introduced via the aperture to the first region of the fluid chamber.

In a device of the first or fourth aspect the control means may be configured to: before actuating the first group of the array elements, actuate a second group of the array elements of the microfluidic device, the first group of the array elements defining a second region of the fluid chamber different from the first region, the second region extending to the aperture.

In a device of the first or fourth aspect the control means may be configured to actuate the second group of the array elements upon detecting working fluid in the second region of the fluid chamber.

In a device of the first or fourth aspect the control means may be configured to actuate the second group of the array elements such that the second region of the fluid chamber matches the region of the fluid chamber occupied by the working fluid.

In a device of the first or fourth aspect the control means may be configured to actuate the second group of the array elements in a time-dependent manner.

In a device of the first or fourth aspect the control means may be configured to actuate the first group of the array elements upon determining that the region of the fluid chamber occupied by the working fluid has reached a predetermined size.

In a device of the first or fourth aspect the control means may be configured to actuate the first group of array elements upon determining that the rate of change of size of the region of the fluid chamber occupied by the working fluid is below a predetermined threshold.

A variant of the fourth aspect provides a microfluidic device comprising upper and lower spaced apart substrates defining a fluid chamber therebetween; an aperture for introducing fluid into the fluid chamber; and a plurality of independently addressable array elements, each array element defining a respective region of the fluid chamber. The device is configured to: determine that a working fluid has been introduced into a first region of the fluid chamber; and provide an output to a user to indicate that the working fluid is present in the first region. Any feature described herein as suitable for use with a device of the fourth aspect may be provided in a device according to this variant of the fourth aspect.

A fifth aspect of the invention provides a method of loading a fluid into a microfluidic device, the microfluidic device comprising: upper and lower spaced apart substrates defining a fluid chamber therebetween; and an aperture for receiving fluid into the fluid chamber; the method comprising: loading a filler fluid into the microfluidic device; disposing the end of a fluid applicator at or near the aperture; dispensing working fluid from the fluid applicator into a loading region adjacent the aperture and external to the fluid chamber; and forcing the working fluid from the loading region into the fluid chamber via the aperture.

The method of this aspect may be used with a device where, when working fluid is initially dispensed from the fluid applicator, the fluid may not load fully into the desired region of the microfluidic device.

Forcing, or urging, the working fluid from the loading region into the fluid chamber may comprise dispensing a second fluid from the fluid applicator to thereby force the working fluid from the loading region into the fluid chamber via the aperture. In this embodiment the fluid applicator is further actuated to dispense a bubble of air (or other fluid different to the working fluid being dispensed), so as to load the working fluid fully into the desired region of the microfluidic device.

The second fluid may be a fluid different to the working fluid. The second fluid may for example be air, or may be filler fluid.

The microfluidic device may be an active matrix electrowetting on dielectric (AM-EWOD) microfluidic device comprising a plurality of independently addressable array element electrodes, each array element electrode defining a respective array element, and each array element defining a respective region of the fluid chamber; and the method may further comprise actuating at least one of the array elements of the microfluidic device to hold the dispensed working fluid in the fluid chamber of the microfluidic device.

The microfluidic device may be an active matrix electrowetting on dielectric (AM-EWOD) microfluidic device comprising a plurality of independently addressable array element electrodes, each array element electrode defining a respective array element, and each array element defining a respective region of the fluid chamber, and forcing the working fluid from the loading region into the fluid chamber may alternatively or additionally comprise actuating at least one array element of the microfluidic device to draw the dispensed working fluid into the fluid chamber of the microfluidic device.

The method may comprise actuating at least one array element in a second region of the microfluidic device, the second region being between the aperture and a target region of the microfluidic device for the working fluid. Whether one array element or multiple array elements are actuated depends on, for example, the volume of droplet being processed and/or on the configuration of the EWOD device, especially the relative values of the cell gap, electrode size and droplet size.

The second region of the microfluidic device may have, at its nearest point to the aperture, a width less than the width of the aperture. (The second region in many cases will extend to the aperture, and possibly through the aperture and into the port, in which case the second region of the microfluidic device has, at the aperture, a width less than the width of the aperture. However, the second region is not required to extend to the aperture.)

The second region may comprise a first part having a width less than the width of the aperture and a second part having a second, greater width, and the boundary between the first part and the second part may be between the aperture and the flow edge of working fluid. (It should be noted that the first and second parts of the second region are defined by actuation of array elements of the EWOD device, and the boundary between the first part and the second part is a notional boundary rather than a physical boundary.)

The method may comprise applying a time varying actuation pattern to the array elements of the EWOD device, so that the boundary between the first part and the second part moves away from the aperture as the flow edge of working fluid moves away from the aperture.

The method may further comprise actuating a target group of array elements corresponding to a target region of the fluid chamber to move working fluid introduced via the aperture to the target region of the fluid chamber. Again, the "target" region is a region of the fluid chamber into which it is desired to load the working fluid.

The method may further comprise: before actuating the target group of array elements, actuating a second group of the array elements defining a second region of the fluid chamber different from the target region, the second region being nearer to the aperture than the target region. In this embodiment the second group of array elements are actuated to assist with initial loading of the working fluid into the microfluidic device and/or to assist with initial movement of the working fluid to the target region for the working fluid. Subsequently the second group of array elements are deactuated, and the target group of array elements are actuated to assist with completion of movement of the working fluid to the target region for the working fluid. The second region may extend to the aperture, or may be spaced from the aperture.

The method may further comprise actuating the second group of array elements upon (for example, in response to) or after detecting working fluid in the second region of the fluid chamber.

The method may further comprise actuating array elements such that the second region of the fluid chamber matches the region of the fluid chamber occupied by the working fluid.

The method may further comprise actuating a target group of array elements of the microfluidic device, the target group of the array elements corresponding to a target region of the fluid chamber, to move working fluid introduced via the aperture to the target region of the fluid chamber.

The method may further comprise actuating the second group of array elements in a time-dependent manner.

The method may further comprise actuating the target group of array elements upon (or after) determining that the region of the fluid chamber occupied by the working fluid has reached a predetermined size and/or upon (or after) determining that the rate of change of size of the region of the fluid chamber occupied by the working fluid is below a predetermined threshold.

The method may further comprise determining that a working fluid has been introduced into a region of the fluid chamber; and providing an output to indicate that the working fluid is present in the region. For example, the region may be a target region of the fluid chamber, into which it is desired to load the working fluid, in which case the output indicates that the working fluid has been successfully loaded into the target region of the fluid chamber. Alternatively, the region may be a region of the fluid chamber into which it is not desired to load the working fluid, in which case the output indicates that an error has occurred in the loading of the working fluid. In the case of manual fluid loading the output is provided to a user and may for example be an audible and/or visual output, whereas in the case of automated or robotic fluid loading the output is provided to a control unit that is controlling the automated or robotic fluid loading and may for example be an electrical or optical signal.

Alternatively or additionally, the method may further comprise determining that working fluid has been introduced into a region of the fluid chamber, comparing the region with a desired region, and providing an output based on the result of the comparison. For example, this method may provide an output (an alert) if the region into which working fluid has been introduced is different to the region into which it is desired to introduce the working fluid. For example if the region occupied by the working fluid is smaller than the region into which it is desired to introduce the working fluid this would suggest that an insufficient amount of the working fluid has been introduced, whereas if the region occupied by the working fluid is larger than the region into which it is desired to introduce the working fluid this would suggest that an excess amount of the working fluid has been introduced. Alternatively, if the region occupied by the working fluid has the same area as, but is displaced from (either partially overlapping or separate from) the region into which it is desired to introduce the working fluid this suggests that the fluid has been introduced into an incorrect region of the device.

Alternatively or additionally, the method may further comprise monitoring the region of the fluid chamber in which working fluid is present as the fluid applicator is withdrawn. If the region in which working fluid is present should decrease in size this would indicate that working fluid has inadvertently been retracted, and an output can be provided to alert the user/control unit. If however the region in which working fluid is present does not decrease in size as the fluid applicator is withdrawn this would indicate that the fluid applicator has successfully been withdrawn without causing retraction of working fluid from the fluid chamber, and an output confirming this may alternatively or additionally be provided.

In a method of the fifth aspect, the device may further comprise a fluid input structure disposed over the upper substrate and having a fluid well for receiving fluid from a fluid applicator inserted into the fluid well, the fluid well communicating with a fluid exit provided in a base of the fluid input structure, the fluid exit being adjacent the aperture; wherein the fluid well comprises first, second and third portions, the first portion of the well forming a reservoir for a filler fluid; the second portion of the well being configured to sealingly engage against an outer surface of a fluid applicator inserted into the fluid well; and the third portion of the well communicating with the fluid exit and having a diameter at the interface between the third portion and the second portion that is greater than the diameter of the second portion at the interface between the third portion and the second portion; and the method may comprise, before dispensing working fluid from the fluid applicator, loading a filler fluid into the microfluidic device such that the filler fluid at least partially fills the first portion of the fluid well; and inserting the fluid applicator into the fluid well such that the outer surface of the fluid applicator sealingly engages against the second portion of the fluid well.

A sixth aspect of the invention provides a method of extracting fluid from an AM-EWOD microfluidic device, the microfluidic device comprising: upper and lower spaced apart substrates defining a fluid chamber therebetween; a plurality of independently addressable array element electrodes, each array element electrode defining a respective array element, and each array element defining a respective region of the fluid chamber; and an aperture for receiving fluid into the fluid chamber; the method comprising:

extracting working fluid from a first region of the microfluidic device, the first region spaced from the aperture, by;

actuating one or more array elements of the AM-EWOD device to move working fluid from the first region to an unloading region adjacent the aperture and external to the fluid chamber; and removing the working fluid from the unloading region into the fluid chamber via the aperture.

A method of the sixth aspect may comprise, before actuating the one or more array elements of the AM-EWOD device, disposing a fluid applicator in the unloading region; wherein removing the working fluid from the unloading region comprises removing the working fluid from the unloading region with the fluid applicator.

A method of the sixth aspect may comprise, before disposing the fluid applicator in the unloading region, actuating one or more array elements of the first region of the AM-EWOD device to hold the working fluid in the first region.

Actuating one or more array elements of the AM-EWOD device to move working fluid from the first region to an unloading region may comprise actuating at least one array element in a second region of the microfluidic device, the second region being between the first region and the aperture. Whether one array element or multiple array elements are actuated depends on, for example, the volume of droplet being processed and/or on the configuration of the EWOD device, especially the relative values of the cell gap, electrode size and droplet size.

The second region of the microfluidic device may have, at its nearest point to the aperture, a width less than the width of the aperture. (The second region in many cases will extend to the aperture, and possibly through the aperture and into the port, in which case the second region of the microfluidic device has, at the aperture, a width less than the width of the aperture. However, the second region is not required to extend to the aperture.)

The second region may comprise a first part having a width less than the width of the aperture and a second part having a second, greater width, the leading flow edge of working fluid being between the aperture and the boundary between the first part and the second part. (It should be noted that the first and second parts of the second region are defined by actuation of array elements of the EWOD device, and the boundary between the first part and the second part is not a physical boundary, but one merely defined by a changing activation pattern applied to the array elements.)

A method of the sixth aspect may comprise applying a time varying actuation pattern, so that the boundary between the first part and the second part moves towards the aperture as the flow edge of working fluid moves towards the aperture.

A method of the fifth or sixth aspect may comprise controlling the pattern of actuated array elements based on a sensed position of fluid in the microfluidic device. Alternatively, other methods may be used such as, for example, applying a predetermined time-varying actuation pattern.

A method of the fifth or sixth aspect may comprise controlling the pattern of actuated array elements to split the working fluid into two portions In any aspect or implementation the microfluidic device may be an EWOD (Electro-wetting on Dielectric) device.

BRIEF DESCRIPTION OF DRAWINGS

Preferred embodiments of the present invention will now be described by way of illustrative example with reference to the accompanying figures in which:

FIG. 5(*b*) corresponds to FIG. 5(*a*) but shows a pipette inserted.

DESCRIPTION OF EMBODIMENTS

Figure 1:
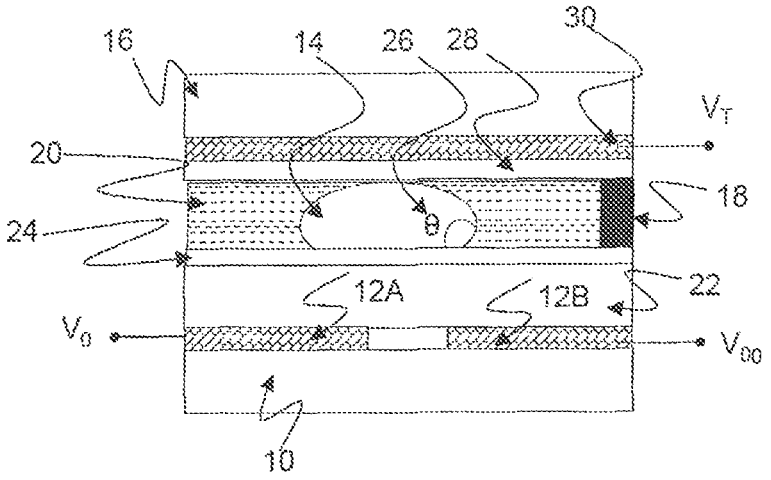
FIG. 1 is a drawing depicting a conventional EWOD device in cross-section.
Figure 2:
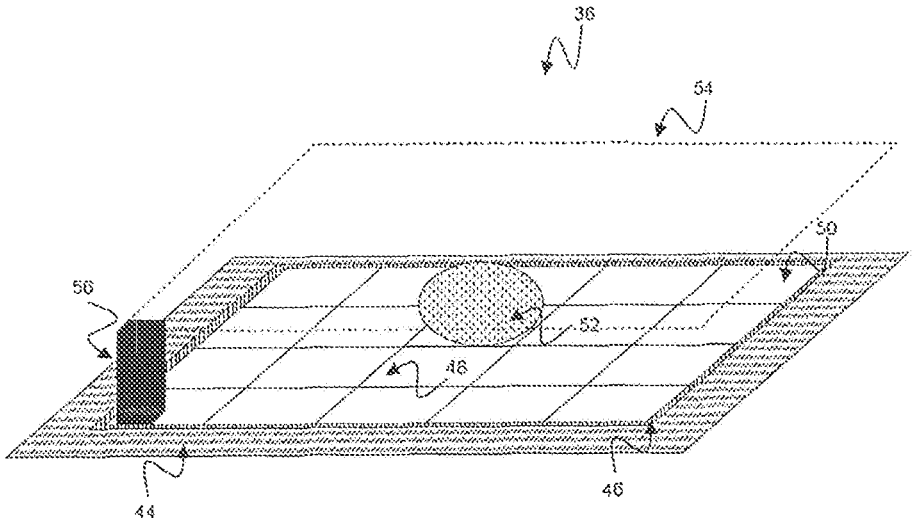
FIG. 2 is a drawing depicting an exemplary AM-EWOD device in schematic perspective.

Embodiments of the present invention will now be described with reference to the drawings, wherein like reference numerals are used to refer to like elements throughout. It will be understood that the figures are not necessarily to scale.

Figure 3:
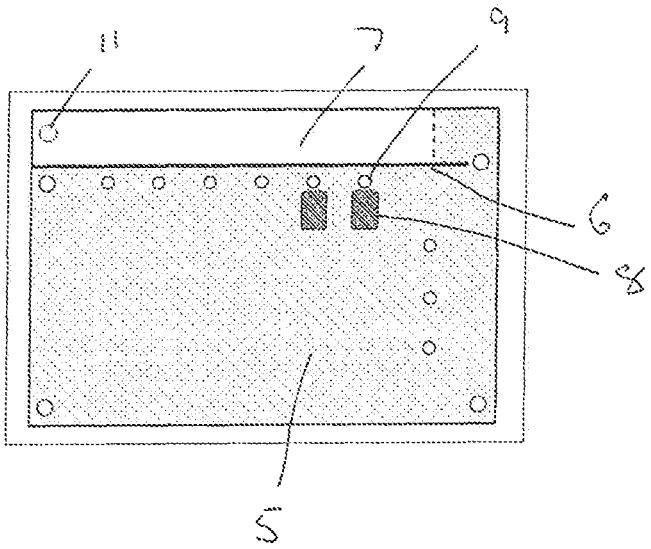
FIG. 3 is a schematic view from above of a microfluidic device as described in WO 2017/047082.

It has been realised that, while the microfluidic device of GB 2542372/WO 2017/047082 shown in FIG. 3 facilitates loading of a working fluid (also referred to as an "assay fluid" or as an "aqueous fluid") into the fluid chamber, there are two problems which may arise on any subsequent heating of the device (as will be required in some applications of such a device).

One problem which may arise in the device of FIG. 3 is that if the total volume of the fluids (filler fluid and working fluid(s)) loaded into the fluid chamber is less than the total volume of the fluid chamber of the device, a bubble of air (or other venting fluid) will remain within the device. So long as the device is held at a uniform temperature (e.g. at room temperature), and the cell-gap of the device is relatively uniform, then this bubble will remain in a controlled position in the region 7 of the fluid chamber, as determined by the design of the barrier 6 and location of the port used for loading the filler fluid. However, if the device is heated in such a way that thermal gradients exist within the device, that air bubble will tend to move towards the hottest part of the device and may move into the region 5 of the fluid chamber which corresponds to the active region of the device.

In principle this problem can be avoided by making sure that exactly the right volume of filler fluid is loaded into the device so that all venting fluid is expelled from the device when the working fluid(s) are loaded, or by topping up with filler fluid after the loading of working fluid(s) loading is finished. However, the first of these is very difficult to achieve in practice, as there will inevitably be small variations in device capacity and pipetting volumes. The second of these is acceptable for laboratory usage, but is not necessarily a desirable aspect for a commercial product intended for use in non-laboratory conditions.

A second problem which may arise in the device of FIG. 3 is that even if all of the required fluids are loaded into the device, with a single loading step of oil (or other filler fluid) and no remaining air bubble, then as the device is heated up, the oil (or other filler fluid) will evaporate into the atmosphere. This reduces the volume of fluids in the fluid chamber, and an air bubble re-appears.

One solution to this first problem is to completely fill the fluid chamber with filler fluid as a first stage of the fluid loading process, and then load working fluid(s) into the fluid chamber when the device is full of filler fluid. Ways of achieving this are described below. However, this does not solve the second problem, as an air bubble may reappear upon heating the device, so this approach is limited to cases where the device will not be heated non-uniformly.

Completely sealing the device to prevent evaporation of filler fluid has been found not to be a solution, because any air gaps between the seal and the filler fluid will expand if the device is heated and these expanded air bubbles can then possibly encroach onto the active area of the device.

1. Loading of Working Fluid Via a Housing

Figure 4:
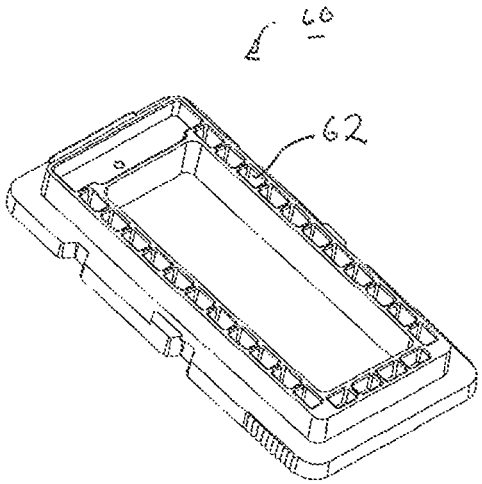
FIG. 4 is a schematic perspective view of a housing for a microfluidic device according to an embodiment of the invention.

FIG. 4 illustrates a housing 60 for a microfluidic device, for assisting loading of working fluid into the microfluidic device. The housing is intended for use with a microfluidic device of the type generally described above, such as an EWOD device, that uses a polar working fluid and a non-polar filler fluid; as such, the working fluid and the filler fluid can, for the purposes of the application, be regarded as immiscible.

Figure 5A:
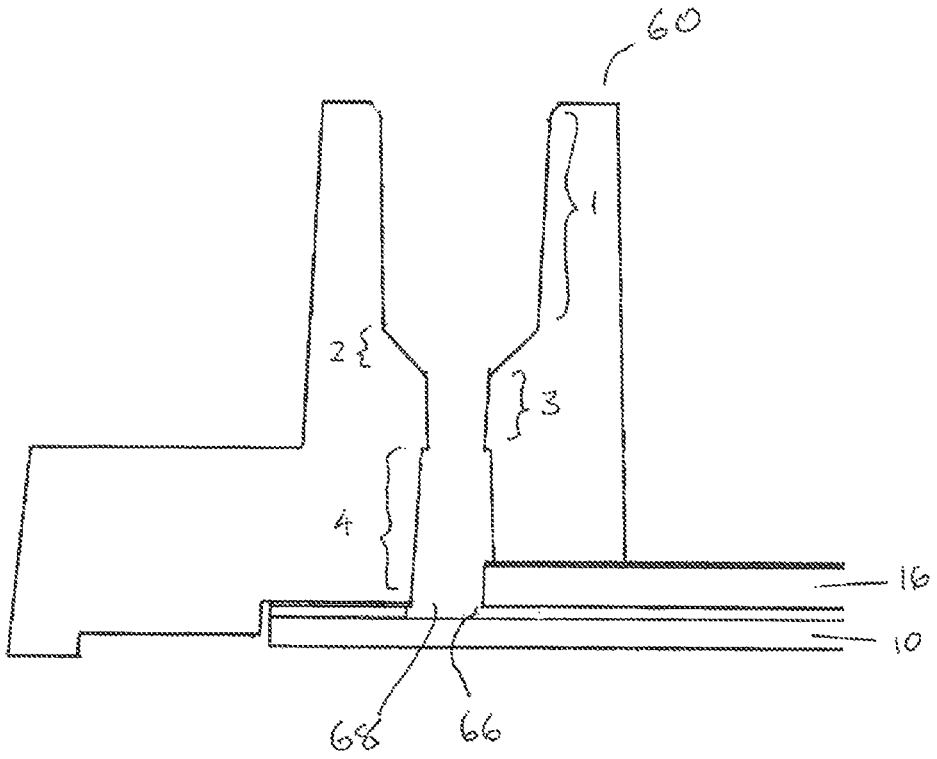
FIG. 5(*a*) is a partial sectional view through a microfluidic device having a housing as shown in FIG. 4.
Figure 5B:
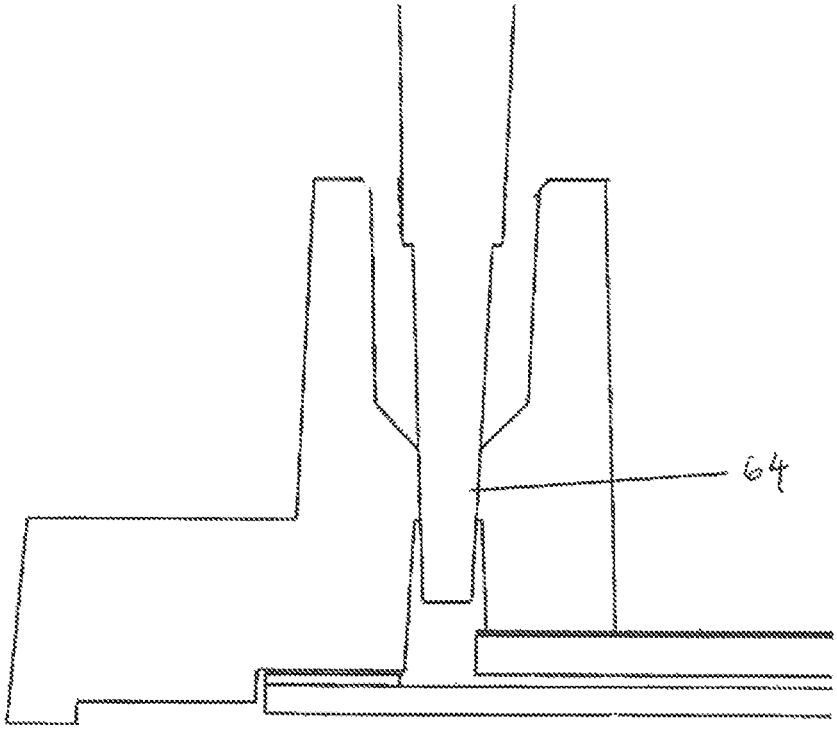

The housing contains at least one fluid well 62, and preferably contains multiple fluid wells. FIG. 5(*a*) is a cross-section of a microfluidic device having a housing 60, through a fluid well of the housing. The fluid wells also function as ports for receiving a fluid applicator for dispensing a working fluid for loading into the microfluidic device. The invention is described herein with reference to embodiments in which a pipette is used as the fluid applicator but any suitable fluid applicator may be used. The invention may be used with for example a fluid applicator that is controlled manually, with a fluid applicator that is controlled remotely by a user (eg is controlled electronically), with a fluid applicator that requires manual insertion into the fluid well but in which the dispensing of fluid is controlled automatically or with a robotic fluid applicator in which both insertion into/removal from the fluid well and the dispensing of fluid are controlled automatically. In the case of automatic control, this may be in accordance with a determined set of instructions. Examples of suitable fluid applicators include pipettes manufactured by Gilson, Inc., for example pipettes from their Pipetman™ range of pipettes. Other examples of suitable fluid applicators include, but are not limited to, a pipette and pipette tip in combination (pipette tips, which may be disposable, may be used with pipettes to speed processing and reduce cross-contamination, and are available in standardised sizes) a disposable dropper pipette, examples of which include the Pastette® range from Alpha Laboratories, Hampshire, UK; a syringe; a burette; a capillary; an automated fluid injector, examples of which include the Drummond Nanoject II™ from Drummond Scientific Company, Pennsylvania, USA.

Further, it may be advantageous to use a fluid applicator that can dispense a pre-determined amount of working fluid, and particularly advantageous to use a fluid applicator that can be loaded with the exact amount of fluid it is desired to dispense such that no working fluid remains in the applicator after the pre-determined amount of working fluid has been dispensed.

FIG. 5(*b*) corresponds to FIG. 5(*a*) but shows the dispensing end 64 of a pipette inserted into the fluid well 62 to a "docked position" suitable for fluid to be dispensed from the pipette. In the docked position of FIG. 5(*b*) in which an outer surface of the end 64 seals against region 3 of the fluid well. (It should be noted that in practice many commercially available pipettes are used in combination with a disposable pipette tip and in such a case the combination of the pipette and disposable pipette tip are inserted into the fluid well, and it is the outer surface of the end of the pipette tip that will seal against the region 3 of the fluid well. References to inserting a "pipette" into a fluid well should therefore be understood as also covering the insertion of the combination of a pipette and a (for example, disposable) pipette tip. Examples of suitable pipette tips for use with a pipette include, but are not limited to, pipette tips supplied by Gilson Inc., Mettler Toledo International Inc (under the Rainin brand), Starlab (UK), Ltd. Eppendorf AG, Alpha Laboratories Limited (the Sartorius range) and/or VWR International, LLC. Examples of suitable sizes of pipette tips include, but are not limited to, sizes: P2, P10, P20, P30, P100, or P200.)

The housing may be manufactured by any suitable process, for example, by plastic injection moulding or by 3-D printing. The microfluidic device may then be positioned in and attached to the housing, and the resultant product is sometimes known as a "cartridge". The housing and microfluidic device may be attached together in any suitable way, for example using an adhesive. In one manufacturing method described in co-pending European patent application No. 18182737.9, the contents of which are hereby incorporated by reference, a substrate of the microfluidic device is initially attached to the housing using double sided adhesive tape. Once it is checked that the housing is correctly positioned, further adhesive may then be introduced into the joint between the housing and the substrate of the microfluidic device, for example by capillary filling, to ensure a fluid-tight seal between the housing and the substrate.

FIG. 4 illustrates a housing 60 for use with a microfluidic device (for example an EWOD device or AM-EWOD device) in which the area of the upper substrate (substrate 16 in FIG. 1) is less than the area of the lower substrate (substrate 10 in FIG. 1) so that the upper substrate does not completely overlap the lower substrate thereby forming one or more apertures 66 for loading fluid into the fluid chamber of the microfluidic device. This aspect of the invention is not however limited to such a microfluidic device, and may also be applied with a microfluidic device in which the upper substrate 16 completely overlaps the lower substrate 10 and one or more apertures for loading fluid are provided in the upper substrate 16. The fluid well 62 communicates with a fluid exit 68 provided in a base of the housing, and the fluid exit is generally adjacent to the aperture 66 in the microfluidic device.

In FIG. 5(*a*) the fluid well/pipette port can be seen to consist of 4 main regions. The regions are arranged in sequence along the axis of the fluid well, with the first region 1 being furthest from the substrates 10, 16 of the microfluidic device, and the fourth region 4 being closest to the substrates 10, 16 of the microfluidic device (and typically making contact with at least the upper substrate 16).

The first region 1, or "reservoir region", is the widest region of the well, with an internal diameter that is greater than the external diameter of the pipette to be used with the well, and forms a reservoir for accommodating oil (or other filler fluid) so that when the microfluidic device and the housing are heated up, the inevitable evaporation that occurs does not lead to an air bubble forming within the channel of the EWOD device. The height and diameter of the first region 1 will be determined by factors such as how much filler fluid needs to be accommodated in the fluid well and the extent to which the level of filler fluid in the reservoir region will rise when a pipette is inserted into the fluid well and displaces some filler fluid.

The second region 2 acts as a transition between the first region 1 (wide) and the third region 3 (narrow).

The third region 3, or "sealing region", is a small diameter region (the cross-sectional diameter of the well is lower in the third region than in the first region) which acts to form a seal with the end of the pipette when it is introduced into the fluid well (and pushed reasonably firmly downwards). The taper angle of the walls in the third region 3 preferably matches the taper of the end of the pipette in order to create a secure seal that exists over some height range and not just at one height (as would be the case if the angle were not the same as that of the pipette tip). (Alternatively, if the pipette, or other applicator, is made of a material that deforms upon insertion into the well a secure seal may be obtained even if the taper angle of the third region does not match the taper angle of the pipette/applicator; in this case the third region may have a zero taper angle and so have a substantially uniform cross-section over its length.)

As described below, in preferred methods of loading working fluid(s) into the fluid chamber the level of the filler fluid within the microfluidic device at the moment when working fluid(s) are being loaded is high enough that the filler fluid extends at least partially into the second region 2 and possibly into the first region 1. The reason for this is that this will ensure that when the pipette is docked into the third region 3, the pipette touches the filler fluid before entering the third region 3. This prevents any undesired air bubbles being forced into the device upon subsequent fluid loading.

In principle the third region 3 could extend all the way down to the end of the port. However, if the housing is to be made by injection moulding, the minimum diameter of any aperture is around 1 mm. Since the end of most commercial pipette tips have a lower diameter less than this, it is necessary for a fourth region 4 to exist, and the draft (taper) of the fourth region 4 must be in the opposite direction to the draft (taper) of the third region 3. Therefore the parting line of the injection moulding tool must be between the third region 3 and the fourth region 4. Because of this it is preferable for the diameter of the port at the upper end of the fourth region 4 to be slightly larger than the diameter of the port at the lower end of the third region 3 (normally 1 mm), in order to minimize the risk associated with any misalignment of the tool parts coming together during production. The height of this parting line above the lower EWOD substrate 10 should be as low as possible without running the risk that a pipette could make contact with the lower EWOD substrate 10 upon fluid loading (which would prevent fluid issuing from the pipette and also risk damage to what could be the 'active' EWOD substrate.

The fourth region 4 may represent a "dead volume", in that some working fluid dispensed from the applicator will remain in the fourth region 4 of the well and will not be introduced in the fluid chamber. It may therefore be desirable to minimise the volume of the fourth region 4, subject to making the diameter of the port at the upper end of the fourth region 4 slightly larger than the diameter of the port at the lower end of the third region 3 and to making the height of the fourth region 4 sufficient to eliminate (or reduce) the risk that the applicator could make contact with the lower EWOD substrate 10 upon insertion into the well.

The cross-section of the third region 3 is complementary to the external cross-section of the dispensing end 64 of the pipette (or other fluid applicator), to provide a seal that extends around the entire circumference of the pipette. This means that in general the third region will have a circular cross-section, as most pipettes (and other fluid applicators) have a circular external cross-section. The cross-section of the other regions of the fluid well may be freely chosen, and may be non-circular if desired. Moreover, while FIG. 5(*a*) shows all regions of the fluid well as being generally co-axial with one another this is not necessary—for example, if it were desired to increase the volume of the reservoir region (the first region 1) the first region 1 could be extended to the left (where "left" relates to a housing oriented as shown in the figure) while leaving the other regions unchanged.

As noted FIG. 5(*a*) shows a housing suitable for use with a 'side-loading' microfluidic device in which apertures 66 for fluid loading are provided at the side edge of the upper substrate 16. The embodiment is however also generally applicable to a 'top-loading' microfluidic device in which apertures for fluid loading are provided in the upper substrate, with appropriate modifications to the housing and the microfluidic device.

It will be understood that FIG. 5(*a*) shows one embodiment of the fluid well, but that variations may be made. As one example, the second region 2 could in principle be omitted and the floor of the first region 1 made flat. However it has been found that this tends to hold back the filler fluid when the filler fluid is first introduced into the housing, as the flat section forms a barrier over which the filler fluid struggles to flow, and that providing the second region 2 with a tapering floor enhances the upwards flow of filler fluid into region 1. Likewise, the second region 2 helps the wells to ensure that all of the filler fluid loaded into the fluid well is available to drain into the channel of the microfluidic device, should filler fluid start to evaporate from region 1.

In the embodiment of FIG. 4, when the microfluidic device is positioned in the housing, the housing extends around the entire periphery of the upper substrate. In principle, however, the housing in general, and the fluid input ports in particular, need not extend around the entire periphery.

In the embodiment of FIG. 4 the housing contains multiple fluid wells. A microfluidic device typically contains multiple apertures for loading fluid into the device, and when the microfluidic device is positioned in the housing some or all of the fluid wells will be adjacent to respective fluid loading apertures of the device. In general there may be one or more wells intended for loading filler fluid and one or more wells intended for loading working fluid. Preferably, each well intended for loading working fluid has a cross-section as shown in FIG. 5(*a*); a well intended for loading filler fluid may have a cross-section generally as shown in FIG. 5(*a*), or may have another cross-section.

In embodiments of the device as described with respect to FIGS. 4 and 5 the internal diameter of region 3 at the interface with region 4 is at least about 0.1 mm, at least about 0.25 mm, at least about 0.5 mm, at least about 0.75 mm, at least about 1 mm, at least about 1.25 mm, at least about 1.5 mm, at least about 2 mm, at least about 3 mm, at least about 5 mm. The internal diameter of region 3 at the interface with region 2 is at least about 0.25 mm, at least about 0.5 mm, at least about 0.75 mm, at least about 1 mm, at least about 1.25 mm, at least about 1.5 mm, at least about 2 mm, at least about 3 mm, at least about 5 mm. The taper angle of region 3 is at least about 0 degrees, at least about 0.25 degrees, at least about 0.5 degrees, at least about 0.75 degrees, at least about 1 degree, at least about 1.25 degrees, at least about 1.5 degrees, at least about 1.75 degrees, at least about 2 degrees, at least about 5 degrees, at least about 10 degrees, at least about 15 degrees, at least about 25 degrees, at least about 45 degrees. The length of region 3 is at least about 0.1 mm, at least about 0.25 mm, at least about 0.5 mm, at least about 0.75 mm, at least about 1 mm, at least about 1.25 mm, at least about 1.5 mm, at least about 2 mm, at least about 3 mm, at least about 5 mm, at least about 10 mm. In an exemplary embodiment the internal diameter of region 3 at the interface with region 4 is 0.99 mm, the internal diameter of region 3 at the interface with region 2 is 1.12 mm, the taper angle of the internal wall of region 3 is 5.1 degrees and the length of region 3 is 1.48 mm."

Some example of methods of usage of these pipette ports will now be described.

Method 1—Rapid Fluid Input

In the first method of usage, the pipette (or other fluid applicator) is loaded with a working fluid as usual, and is then inserted into the relevant fluid well. The housing and microfluidic device have already been loaded with filler fluid, such that the level of filler fluid is in the first region 1 or the second region 2 of the fluid well(s) and the fluid chamber of the device is completely filled with filler fluid. The pipette is inserted into the fluid well such that the outer surface of the end of the pipette sealingly engages against the sealing region (the third region 3) of the fluid well as described above. Fluid is then dispensed from the pipette into the fourth region 4 of the fluid well and so into the fluid chamber of the device. As the aperture in the pipette (or other fluid applicator) from which fluid is dispensed is immersed in filler fluid (it is below the level of filler fluid in the fluid well) there is no risk of air being inadvertently introduced into the fluid chamber of the device.

It can therefore be seen that the fluid well of this aspect provides the following advantages:

- It can be flooded with oil (or other filler fluid) on initial loading of filler fluid;
- It forms a reserve of filler fluid, and so avoids the need for a dedicated reserve which takes up valuable space around the perimeter of the device
- It can provide successful loading of working fluid, even when the microfluidic device is filled with filler fluid.

In the case of a manual pipette, one method for dispensing working fluid after insertion of the pipette as described above is for the user to then push the pipette plunger slowly down from its "fully out" position, firstly to the usual 'stop' so that the working fluid issues from the end of the pipette into the fourth region 4 of the pipette port. Many available pipettes allow a predetermined volume of working fluid to be dispensed pushing the pipette plunger from its "fully out" position down to the 'stop'. The user then continues to push the pipette plunger slowly down beyond the 'stop', so that a fluid different to the working fluid (for example an air bubble) issues from the end of the pipette, and pushes the working fluid expelled from the pipette away from the end of the pipette, and, via the aperture 66, into the main channel of the EWOD device between the upper and lower substrates 10, 16. If the user makes one continuous push of the plunger of the pipette down to and past the "stop", the working fluid is only momentarily present in section 4 before being forced into the device as the user pushes the pipette plunger beyond the 'stop' in the pipette. Once the working fluid is safely loaded into the device, the pipette can be retracted from the device with the plunger held in the 'down' position (that is, in the position past the stop to which the plunger was pushed to expel the second fluid). Provided that the air bubble has remained connected to the pipette, when the pipette is retracted from the device little or no air remains in the device (although it may result in an air bubble residing within the fourth region 4 of the fluid well after removal of the pipette).

In further embodiments of this method the electrodes of the device may be controlled in order to further ensure that working fluid loaded into the device is not inadvertently extracted when the pipette (or other fluid applicator) is retracted from the well. This is described further in section 2 below.

Method 2—Fluid Input Suitable for Subsequent Heating

The method described above is suitable for room temperature operation of the device, but may result in an air bubble residing within the fourth region 4 of the fluid well after removal of the pipette (or other fluid applicator). This may be undesirable as, upon heating the device, it is possible that the air bubble could move into the EWOD chamber, especially if this area of the device is hotter than the perimeter.

In an alternative method, the user proceeds in exactly the same fashion as in method 1, except that once it is safe to take the pipette out from the well, the user instead first allows the pipette plunger slowly back up into the 'fully out' position. Provided that the air bubble has remained connected to the end of the pipette, both the air bubble and a volume of filler fluid (equal to the volume of working fluid just loaded) are retracted into the pipette. Then the pipette can safely be retracted from the well without any risk of leaving an air bubble inside the device. This method has the added feature of maintaining the original level of filler fluid within the device (in method 1, the level will rise for each working fluid loaded).

In further embodiments of this method the array elements of the device may be controlled in order to further ensure that working fluid loaded into the device is not inadvertently extracted when the pipette is retracted. This is described further in section 2 below.

Method 3—Fluid Extraction

The pipette ports described in this application are bidirectional: they can be used to extract fluid as well as inject it. In order to extract working fluid from the device, preferably the working fluid should be positioned as close as possible to the relevant pipette port, and a 'shrinking hold' electrode pattern applied, for example as described in EP 3311919.

Once this adaptive holding pattern has been applied, the user should take a pipette, push down the plunger to the desired extract volume, insert the pipette into the relevant pipette port and slowly allow the plunger to come back out. Provided that the aspiration volume of the pipette is high enough, then the desired droplet will be extracted successfully. (The "working fluid" that is removed is not necessarily the same as the "working fluid" loaded into the fluid chamber, for example if an assay is being performed. In this case, to avoid contamination of the fluid that is being extracted, the pipette used for this fluid removal is preferably a different pipette, or has a new disposable pipette tip attached, than was used for fluid loading into the device.)

While methods 1, 2 and 3 have been described with reference to direct manual control of the pipette by the user, these methods may alternatively be implemented by remote control, automatic control or robotic control.

2. Array Element Control to Assist Loading of Working Fluid

The basic concept of this aspect of the invention is to control array elements of an EWOD microfluidic device to guide fluid loaded into the fluid channel of the EWOD device channel into a 'safe' position, and give feedback to the user that this has been done. As a result, when the pipette tip is retracted from the device, all of the loaded working fluid remains on the device (although filler fluid/oil may be lost).

The array element control of this aspect may be applied in combination with the fluid loading method described in part 1 above, but it is not limited to this and may be applied with any fluid loading method. It is of most use in the case where the device cell gap is below a certain critical value (between 250 um and 500 um), and the user is trying to introduce working fluid when the device is already full of filler fluid.

Method A—Fluid Loading

Figure 6:
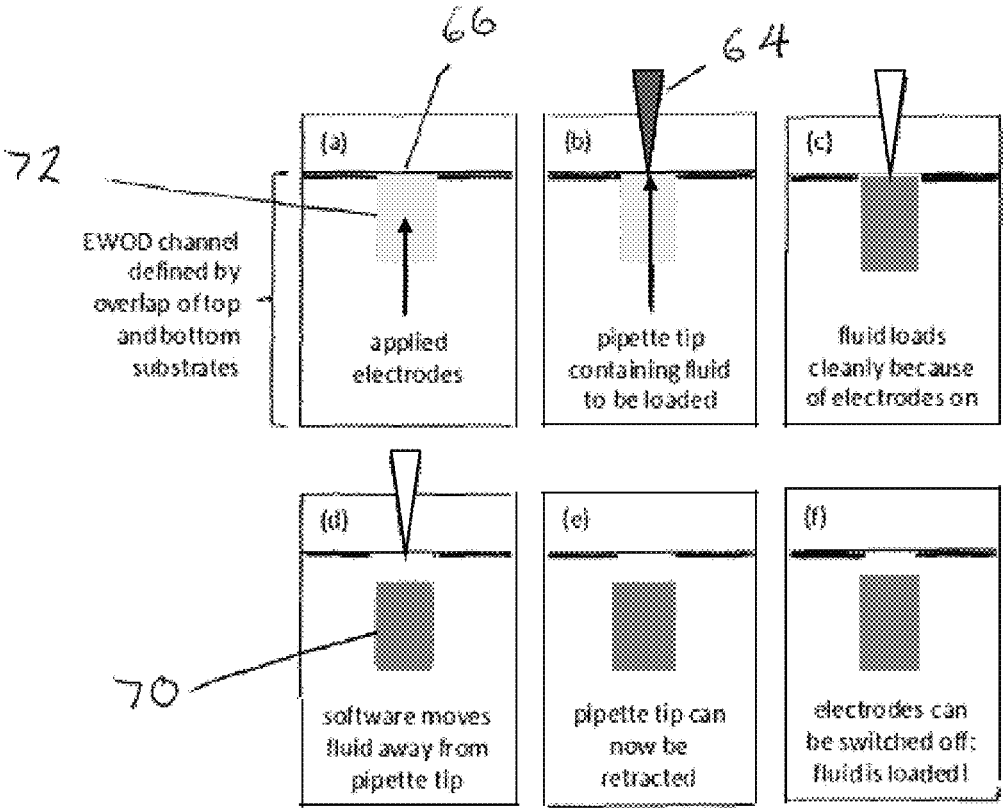
FIGS. 6(*a*) to 6(*f*) are schematic views from above of a microfluidic device illustrating a method of loading fluid into the device according to an embodiment of the invention.

The simplest example of array element control to assist loading of working fluid is illustrated in FIG. 6, which shows a top-down view of an EWOD device which has a lower substrate which is larger in extent than the upper substrate, so providing a loading aperture along one of the sides of the top substrate. It is desired to load a working fluid into a first region (or target region) of the microfluidic device, for example the region 70 shown in FIG. 6(*d*).

In this aspect, the microfluidic device has a plurality of independently addressable array elements (for example, an AM-EWOD microfluidic device), with each array element corresponding to a respective region of the fluid chamber. As described with reference to FIG. 1, an array element of the microfluidic device may be defined by a corresponding array element electrode 12A, 12B. The array elements are controlled by an EWOD control means that is configured to determine that a working fluid has been introduced into the region 70 of the fluid chamber, and provide an output signal to indicate that the working fluid is present in the target region 70. The target region 70 corresponds to a first group of one or more of the array elements. In the case of manual loading of fluid the output signal may be an audible or visual signal provided to alert the user that the working fluid is present in the region 70, and in the case of automatic or robotic loading of fluid the output signal may be provided to the system controlling the automatic or robotic loading of fluid.

In the method of FIG. 6, initially (FIG. 6(*a*)) a second group of one or more of the array elements, corresponding to a second region 72 of the microfluidic device, are actuated by the EWOD control means. The second region 72 is different from the first (target) region 70, although there may be some overlap between the first region and the second region; the first group of one or more of the array elements is therefore different from the second group of one or more of the array elements, although it is not excluded that at least one array element may be common to both the first and second groups.

In this embodiment it is assumed that controllable array elements are provided up to the fluid loading aperture 66. The second region 72 therefore extends to, or very close to, the aperture 66.

At FIG. 6(*b*) the end of a pipette, or other fluid applicator, is positioned adjacent to the fluid loading aperture 66.

Fluid is then dispensed from the pipette or other fluid applicator. This may for example be performed as described above with reference to "method 1" or "method 2" for fluid loading, or it may be done in any other suitable way. As shown in FIG. 6(*c*), the dispensed fluid loads cleanly into the second region 72 of the microfluidic device since the array element(s) of the second region 72 are actuated.

The EWOD control means then ceases actuation of the second group of array elements defining the second region 72, and actuates the first group of array elements defining the first (target) region 70 of the microfluidic device. As a result, the fluid that was loaded in to the device in step (c) is moved into the first region 70, as shown in FIG. 6(*d*).

Once the fluid is moved into the first region 70, the pipette can then be retracted without any risk of accidentally withdrawing the dispensed fluid from the microfluidic device. FIG. 6(*e*) shows the device after removal of the pipette.

The EWOD control means then ceases actuation of the first group of array elements defining the first (target) region 70 of the microfluidic device, and the fluid remains in the first region as shown in FIG. 6(*f*). The array elements may then be controlled to perform any desired droplet operation on the fluid introduced into the first region.

As noted, at the end of step (d) feedback is preferably provided to the user to let them know that the fluid has been moved into the target region 70 and that it is safe to retract the pipette tip. This feedback could for example be in the form of an audible signal, or a visual cue from the software graphical user interface (GUI) (or both). Note that as in the two possible fluid loading methods disclosed in section 1 above, there are two options when retracting the pipette tip: either it can be retracted with the plunger still down (in which case the level of filler fluid within the device grows as a result of the loading of working fluid), or the plunger can be slowly let back up to its natural resting position, in order to draw out a volume of filler fluid that matches that of the working fluid just loaded (in which case the level of filler fluid remains constant). These two methods are applicable to all embodiments in this section.

There are many variants on this simplest case above. Firstly, there are variants in the array element actuation patterns applied, and these will be described below. Then there is the applicability of each of these different actuation patterns to different device structures, which include:

a) Simple 2-substrate device as above, with no housing, where controllable EWOD array elements are provided up to the injection point (as in FIG. 6);
b) As above, but where there is a physical gap between the pipette injection point and the nearest controllable EWOD array element (as described with reference to FIG. 7);
c) A device having a housing as described in section 1 above, where the fluid is injected forcibly by pipettes which are fluidically sealed to the housing.

Figure 7:
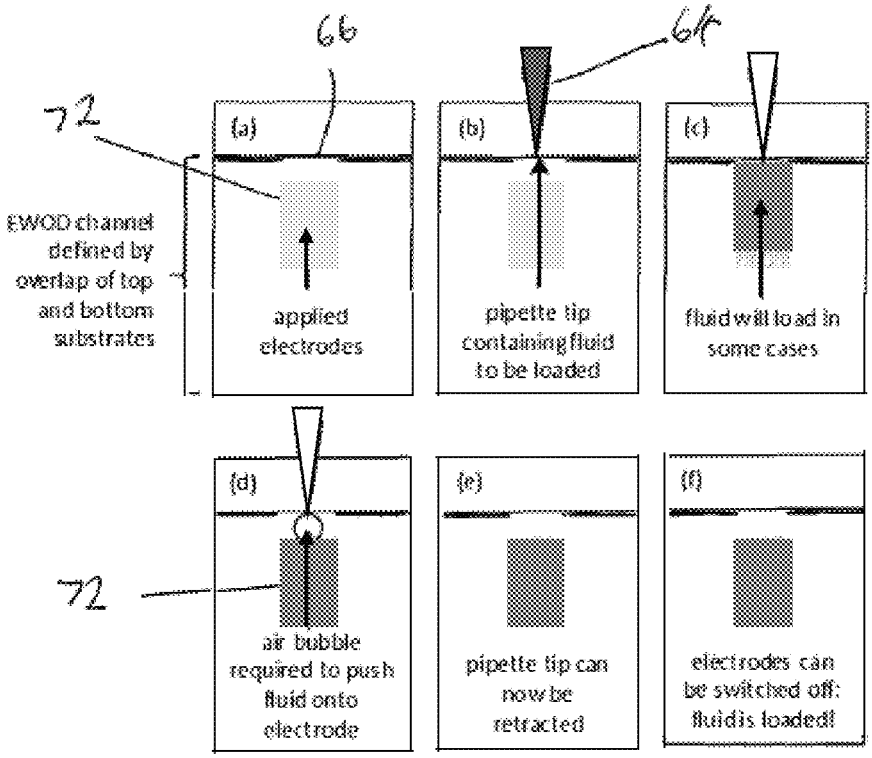
FIGS. 7(*a*) to 7(*f*) are schematic views from above of a microfluidic device illustrating a method of loading fluid into the device according to another embodiment of the invention.

The applicability of each of the actuation patterns to these 3 different device types will sometimes depend on the device cell gap and will (in many cases) be dependent on using the method of 'pushing through the stop' of the pipette in order to use a temporary air bubble to push the fluid away from the end of the pipette and onto the one or more of the element electrodes of the EWOD device, as shown in FIG. 7. Some steps of the method of FIG. 7 are similar to the corresponding step of the method of FIG. 6, and only the difference will be described.

In the method of FIG. 7 it is assumed that controllable array elements of the EWOD device are not provided up to the fluid loading aperture 66. There is therefore a gap between the first region 70 and the aperture 66. As a result, when fluid is dispensed from the pipette, the fluid may not load fully into the first region 70, as indicated in FIG. 7(*c*).

As a result, the pipette (or other fluid applicator) is further actuated to dispense a bubble of air (or other fluid different to the working fluid being dispensed), so as to load the working fluid fully into the second region 72 as shown in FIG. 7(*d*). Provided that the air bubble remains connected to the end of the pipette, once the working fluid is loaded into the second region 72 the pipette may be actuated to withdraw the air bubble from the fluid chamber of the device and back into the pipette, with the working fluid being held in the device owing to the actuation of the array elements. Once this is done, the pipette can be retracted as shown in FIG. 7(*e*). The EWOD control means then ceases actuation of the second group of array elements defining the second region 72 (FIG. 7(*f*)), and actuates the first group of array elements defining the first (target) region 70 of the microfluidic device, to move the fluid to the first region 70 (not shown).

In a modification of this method, the target region may be sufficiently close to the aperture 66 so that, once working fluid has loaded into the microfluidic device as shown in FIG. 7(*d*), the working fluid may be moved directly to the target region by actuating the group of array elements defining the target region 70 of the microfluidic device. This corresponds to FIG. 7(*d*), except that working fluid is loaded into the target region 70. The pipette can then be retracted, and the EWOD control means then ceases actuation of the array elements defining the target region.

In the method of FIG. 7 feedback is again preferably provided to the user at the end of step (d), to let them know that the fluid has been moved into the target region 70 and that it is safe to retract the pipette.

This aspect is not limited to the specific actuation pattern of FIG. 6 or FIG. 7, and many variants are possible. For example, the description of these methods assumes that the shape of the second region 72, in which the EWOD elements are actuated, is rectangular, and remains constant as fluid is drawn towards the first (target) region 70. In other embodiments, however, the shape of the second region 72, in which the EWOD elements are actuated, need not be rectangular, and/or need not remain constant as fluid is drawn towards the first (target) region 70.

Method B—Fluid Loading

In this method, no array elements are actuated initially, but once working fluid is sensed as being introduced into the fluid chamber of the device, for example in any of the ways described with reference to method A above, array elements are actuated. This corresponds to FIG. 6 or FIG. 7, but with the second group of array elements not being actuated until working fluid had been detected as having entered the fluid chamber.

In a related variant, no array elements are actuated initially and array elements are again actuated once working fluid is sensed as being introduced into the fluid chamber of the device. In this variant, however, the group of array elements that are actuated is time-dependent, so that the second region 72 changes with time to match the current volume of fluid introduced into the fluid chamber and to shape the fluid into a prescribed shape (e.g. circular or rectangular). When the fluid stops growing in size, the EWOD control means then ceases actuation of the second group of array elements defining the second region 72, and actuates the first group of array elements defining the first (target) region 70 of the microfluidic device in order to move the fluid away from the aperture 66 to the first (target) region 70, as in the example above, before giving the user the cue to retract the pipette. This variant may be particularly useful if the volume to be loaded is unknown, or particularly small.

The group of array elements that are actuated to define the time-dependent second region 72 may be based on the sensed volume of working fluid that has entered the fluid chamber, as described further below, to provide adaptive control of the array element actuation. Alternatively the group of array elements that are actuated to define the time-dependent second region 72 may be actuated according to a pre-set pattern that is expected to correspond to the rate at which fluid enters the fluid chamber.

Method C—Fluid Loading

In this method, there is no change in the array element actuation pattern at all. A fixed group of one or more array elements is actuated to define an actuated region of the device at a 'safe' distance from the edge of the EWOD fluid channel ('safe' meaning that if the fluid reaches the actuated region, then it is possible to retract the pipette (or other fluid applicator) without taking any of the working fluid out of the EWOD channel). When it is determined that the fluid has reached the actuated region of the device the control means, for example the EWOD control unit mentioned above, gives or causes to be given, an audible or visual cue to the user to retract the pipette. In this case it will always be necessary to use the 'push through the stop' method for the pipette in order to provide the air bubble to push the dispensed fluid from the aperture 66 to the actuated array elements.

This second variant corresponds to the method of FIG. 7, except that a fixed group of one or more array elements is continually actuated until after the pipette has been retracted, so that the region 72 is the same as the region 70

Method D—Fluid Loading

This method is a combination of the second and third methods, in which no array elements are actuated initially, but a time dependent group of array elements are actuated once the fluid has reached the "safe zone" of the EWOD channel (eg, has reached the target region 70). This variant can be used in cases where there simply are no electrodes within the 'unsafe' zone of the EWOD channel, and may be advantageous in other cases where there are electrodes in that zone. The group of array elements that are actuated may be based on the sensed volume of working fluid to provide adaptive control of the array element actuation, or may be actuated according to a pre-set pattern.

The above description of the methods 1 to 4 refers to the working fluid being 'safe' or to 'safe' and 'unsafe' zones within the fluid channel of the EWOD device. As used herein, an "unsafe zone" refers to a zone around the injection point (eg the fluid aperture 66) in which, should a droplet of working fluid happen to reside at the moment of pipette extraction, it may (depending on the force of the user during this extraction process) be at risk from being extracted from the fluid channel, even if EWOD array elements are actuated to hold it as the electrowetting force produced by the electrodes is relatively weak. The extent of the "unsafe" zone will depend on many things, such as EWOD voltage, the thickness of the EWOD dielectric, the pipette extraction speed, working fluid viscosity, cell gap, and proximity of the end of the pipette from the droplet at the moment of extraction, to name but a few. It could be up to several mm in extent. Conversely, a "safe zone" refers to a zone that is sufficiently far from the fluid aperture 66 that, should a droplet of working fluid happen to reside at the moment of pipette extraction, the droplet is at minimal or no risk of being extracted from the fluid channel.

The size and/or location of the "unsafe" zone may be determined by the device manufacturer/supplier, based on characteristics of the microfluidic device such as the cell gap and the size of a fluid aperture 66. Alternatively, the size and/or location of the "unsafe" zone may be determined for a particular fluid loading process, as the size of the unsafe zone may also depend on the characteristics of the particular fluid being loaded as well as on characteristics of the device. Where the size and/or location of the "unsafe" zone are determined for a particular fluid loading process, this may be done manually by a user, or may be done by a control unit (such as the EWOD control unit that controls actuation of the array elements).

Defining the size and/or location of the "unsafe" zone could be as simple as defining a conservative unsafe zone around each injection point. Once that unsafe zone has been judged to have been successfully traversed by the loaded fluid, and the unsafe zone vacated (perhaps by a certain time), the signal that the pipette may be retracted can be given.

One factor that may influence which array element actuation pattern to use is the structure of the microfluidic device, as set out in the table below.

Note that, in all cases, all the methods A to D should be possible above a critical cell gap for the microfluidic device. This table concentrates on a case of interest, which is that of devices with lower cell gaps where the fluid loading is more challenging. In the cases where there is a physical gap between the end of the pipette (or other fluid applicator) and the applied electrodes, an air bubble will be required to separate the fluid from the pipette.

| Method | No housing, aperture adjacent to array elements (a)* | No housing, aperture separated from array elements (b)* | Housing enabling forced fluid loading (c) |
|---|---|---|---|
| A | yes | no | yes (bubble) |
| B | no | no | yes (bubble) |
| C | no | no | yes (bubble) |
| D | no | no | yes (bubble) |

*Note that the success of the fluid loading into the devices without a plastic housing ((a) & (b)) will be highly dependenton the cell gap of the device, and there will be a critical cell gap below which the fluid loading without a housing that can seal around the fluid applicator will not be possible. It is expected that this critical cell gap will be higher for the cases where the electrodes are not adjacent to the pipette (b). Exact cell gaps will be dependent on the specific filler fluid and working fluid(s).

In this table, "yes (bubble)" indicates that the method may be applied but that, for devices with low cell gaps, it may be necessary to dispense an air bubble to force the dispensed fluid into the fluid chamber of the device.

After the pipette has been retracted, the droplet can subsequently re-enter the 'unsafe' zone of the device, as it is no longer unsafe in the absence of the pipette. It may be advantageous to allow this, because it allows for a better use of the EWOD channel area for subsequent droplet operations, and hence allowing the droplet to return to the 'unsafe' zone once the pipette has been retracted, could be applied with any one of the array element actuation patterns above. For example, in the case of manual operation, once the pipette has been retracted the user may give some signal (e.g. a key stroke or mouse click) to indicate this to the controller, and the EWOD control unit may then be enabled to actuate the array elements to draw the droplet into the previously "unsafe" zone. Similarly, in a fully robotic implementation the control unit that controls the physical location of the pipette, or a sensor monitoring the pipette position, may provide a signal indicating the pipette has been retracted.

Method E—Loading Fluid

This method represents an alternate implementation of Method A described with respect to FIG. 6(*a*)-(*f*). In this embodiment the activation of array elements that define the second region 72 is done in such a way that the width of second region 72 is less than the width of the aperture 66 through which working fluid is introduced into the fluid chamber, maintaining a gap for filler fluid to flow between the working fluid and the edge of the aperture.

Figure 8:
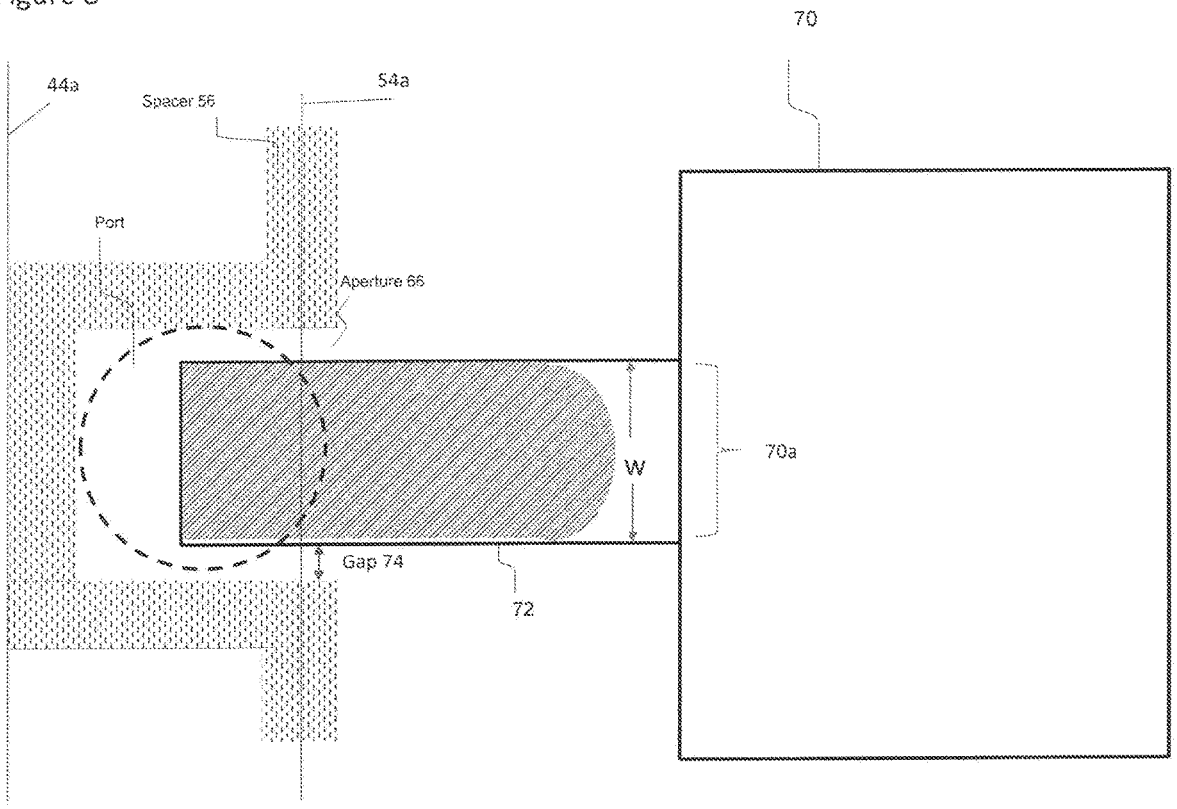
FIG. 8 is a plan view of an AM-EWOD device illustrating a method of fluid loading.

This embodiment is illustrated in FIG. 8, which is a partial plan view of an AM-EWOD device. The figure shows a "side-loading" embodiment, in which the upper substrate of the AM-EWOD device is smaller than the lower substrate, as shown in FIG. 5(*a*). The lines 54*a* and 44*a* in FIG. 8 denote the edges of the upper substrate 54 and the lower substrate 44 respectively. The spacer 56 that spaces the upper substrate from the lower substrate is shaped to define one or more ports (only one port is shown in FIG. 8) via which fluid can be loaded into the AM-EWOD device via the aperture 66. If desired, a housing 60 as described above may be provided on the EWOD device.

Prior to introducing the fluid applicator into position adjacent to fluid loading aperture 66, array elements defining a narrow second region 72 are activated by the EWOD control means along with the array elements defining first (target) region 70. The fluid applicator may then be introduced into the port and dispensing of fluid commenced. FIG. 8 illustrates the device after fluid has been dispensed, with the shaded region corresponding to the portion of the device occupied by introduced working fluid.

As fluid is dispensed from the fluid applicator, the working fluid preferentially travels along the activated array elements defining the second region 72, towards the first (target) region 70. According to this embodiment, the second region 72 of the microfluidic device has, at its nearest point to the aperture, a width less than the width of the aperture. In FIG. 8 the region of working fluid extends to and through the aperture so that the nearest point of the second region 72 to the aperture is at the aperture, but in other embodiments the second region may not extend to the aperture. A result of the lower width of the region of working fluid is that gaps 74 are provided between the working fluid and each edge of the apertures, and in so doing working fluid may be prevented from making direct contact with the edges of the loading aperture 66 or other edge regions of the device such as edges of the spacer that define the port, such that working fluid is guided to first (target) region 70. That is, the width w of the second region 72 is less than the width of the aperture 66, so that at least one edge of the second region 72, and preferably each edge of the second region 72, is separated from the respective edge of the aperture by a gap 74. As working fluid enters the chamber, filler fluid may be displaced. Initially filler fluid may move into the port via the aperture 66 through the gaps 74, thus filler fluid essentially acts as a barrier to prevent working fluid from making contact with edges of the aperture 66.

Once the introduced working fluid has been moved into the second region 72, the EWOD control means then ceases actuation of the second group of array elements defining the second region 72, and actuates the first group of array elements defining the first (target) region 70 of the microfluidic device. As a result, the fluid that was loaded in to the device is then moved into the first region 70, as described with reference to FIG. 6(*d*).

The line 70*a* in FIG. 8 denotes the boundary between the first region 70 and the second region 72. It should be noted that the first and second regions are defined by actuation of array elements of the EWOD device, and the boundary between the first region and the second region is not a feature of the device and may be considered as a notional boundary rather than a physical boundary. The first and second regions are defined purely as a result of activation of individual array elements of the device.

Advantageously and preferably, the gaps 74 are small and may be controlled (by choice of actuation pattern) to be the width of one or two array elements for each gap 74. (In current devices an array element may typically have a width of 200 um or greater (although array elements of 100 um or 50 um may also be possible), so the gap 74 may in principle have a width of as little as 200 um or even less. A typical width of a gap is about 400 um, but a gap could be between about 100 um and about 2 mm according to the dimensions of individual array elements. In principle, the gap between the working fluid and one edge of the aperture need not be the same as the gap between the working fluid and the other edge of the aperture. Further, in principle there could be a gap only between the working fluid and one edge of the aperture with there being no gap between the working fluid and the other edge of the aperture. An aperture 66 has a typical width of 1 to 2 mm.) This is preferable to reduce the risk of accidentally injecting an air bubble, and works as follows: by keeping the width of the second region relatively wide (while still providing the gaps 74), back pressure transmitted through to the pipette (or other applicator) is maximised (equivalently "wash back" of oil through the gaps is allowed but minimised). Thus any air bubble entering the port has a tendency to remain in the region of the port/fluid applicator and to be withdrawn back into the fluid applicator when the pressure is released (rather than being injected out of the fluid applicator and onto the array or trapped against an edge of the loading aperture 66 by the "wash back" of oil). Equivalently, keeping the width of the second region relatively wide (while providing the gaps 74) is beneficial to ensuring working fluid is readily transferred into the chamber, avoiding contact with the spacer 56.

Figure 9:
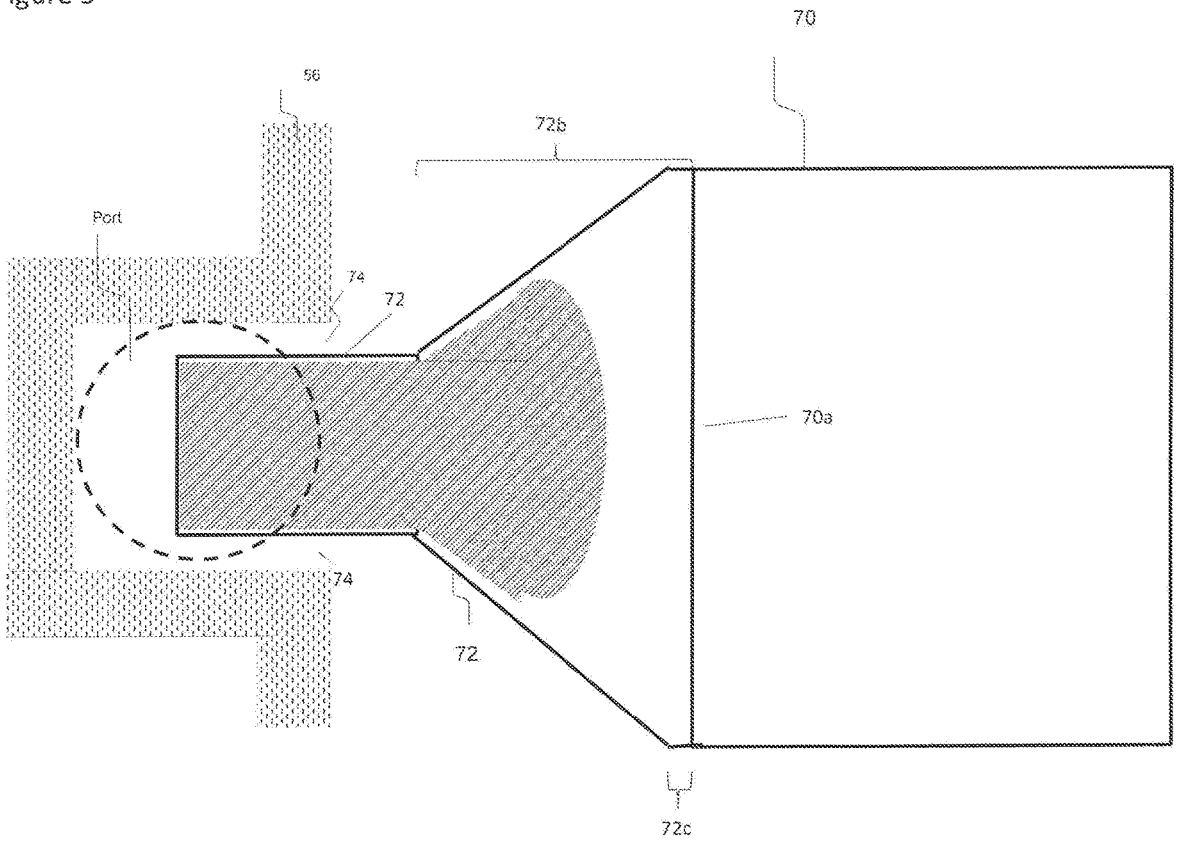
FIG. 9 is a plan view of an AM-EWOD device illustrating another method of fluid loading.

FIG. 9 shows a further embodiment. This corresponds generally to the embodiment of FIG. 8, except that the second region 72 does not have a constant width in the embodiment of FIG. 9. The shaded region again corresponds to the portion of the device occupied by introduced working fluid. The width w of the second region is generally less than the width of the target region 70, and the second region 72 in FIG. 9 thus comprises an "introduction region" 72*a* of width w (which is less than the width of the aperture 66 to provide the gaps 74), and a "transition region" 72*b* in which the width of the second region increases from w to a width approximately equal to the width of the target region 70. (In FIG. 9 the "transition region" 72 is shown as having a portion 72*c* of width equal to the width of the target region, but the transition region does not need to include such a region.)

In this embodiment the triangular shape of EW pattern is an advantageous feature for the above reasons, in keeping the filler fluid gap narrow in the second region. One benefit of controlling the filler fluid gap 74 along the edge of the spacer is that it mitigates contact of working fluid with the spacer, thereby reducing risks of contaminating the working fluid, or of contaminating the spacer. Another advantage, as will be discussed below, is that controlling the filler fluid gap in the port is that it minimises the risk of air bubbles becoming trapped in the chamber in cases where it is necessary to push working fluid from the fluid applicator using a second fluid, which may be filler fluid or air.

According to a refinement of the above method, the integrated capacitance sensor of the Active Matrix EWOD device may be used to implement feedback, operating the device in a "closed loop" form. Accordingly, the actuation pattern applied may be modified over time in conjunction with the position of the working fluid, which is determined through the capacitance sensor circuit, as it advances through the narrow second region.

Figure 10:
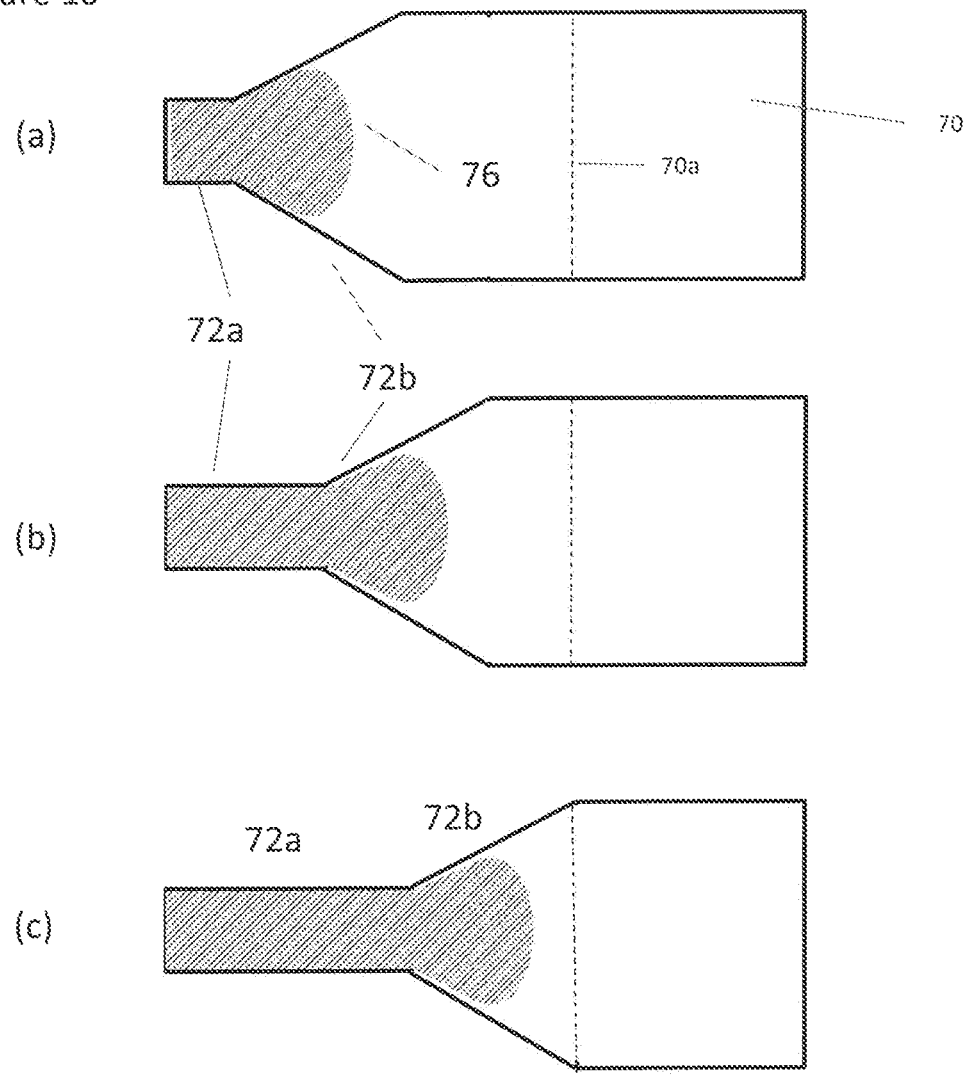
FIGS. 10(*a*), 10(*b*) and 10(*c*) are plan views of an AM-EWOD device illustrating another method of fluid loading.

In particular, as the leading edge of the working fluid advances, the width of the actuation pattern may be narrowed behind it, as shown in FIG. 10(*a*)-(*c*). In these figures the shaded region again corresponds to the portion of the device occupied by introduced working fluid. Initially, as shown in FIG. 10(*a*) the edge 76 of the working fluid is close to the aperture 66, and the length of the introduction region 72*a* is small so that the start of the transition region 72*b* is also close to the aperture 66. As the EWOD control means detects that the fluid edge 76 has advanced, the EWOD control means controls the region in which EWOD elements are actuated so that the length of the introduction region 72*a* increases—so that the distance between the aperture and the start of the transition region 72*b* also increases as shown in FIGS. 10(*b*) and 10(*c*) This has the effect of reducing the width of the actuated region of the EWOD device behind the fluid edge. This is advantageous since the narrowing of the actuation pattern behind the advancing edge of the working fluid droplet may avoid electro-wetting the "sides" of the advancing droplet edge, and thus concentrates or focuses the forward movement of the working fluid into the chamber.

An advantage of the "closed loop" of operation here described, which uses feedback from the capacitance sensor to determine the position and shape of the advancing working fluid droplet is that the method is more tolerant to variations in the speed with which a user manually introduces working fluid using the fluid applicator, resulting in a more desirable introduction of working fluid to the chamber, including aspects of more reliable fluid input, avoidance of fluid touching the spacer, avoidance of air bubble injection; all regardless of the speed or technique of the user. When a smart fluid applicator is used, the same sensor feedback provides improved control over the rate and volume of working fluid delivered to the device.

Status information/notifications may be provided to a user during the process of loading working fluid into the chamber. Initially, the user may receive notification, based on feedback from the capacitance sensor, that indicates successful commencement of the loading process, confirming that working fluid has made initial contact with the second region 72. Thereafter, notifications may be provided, for example on a regular basis, as the loading process progresses, to ensure the rate of introduction of working fluid is an appropriate rate to mitigate departure of working fluid from the activated array elements that represent second region 72 and first (target) region 70. In the cases where a manually operated fluid applicator is being used, the notification may be in the form of an audible signal, a visual cue from the software GUI, or both, which may prompt the user to apply working fluid either more rapidly or more slowly, as appropriate. When enough working fluid has been introduced to the chamber, further notification may be provided to indicate that a user may safely stop loading working fluid and withdraw the fluid applicator.

If an automated fluid applicator is being used, sensor feedback may be used to control the rate of fluid dispensing and the volume of fluid dispensed.

In principle the embodiment of FIGS. 10(*a*) to 10(*c*) could be effected without sensing the position of the fluid edge, for example by an EWOD control means applying an EWOD element actuation pattern that varies with time in a pre-programmed manner.

Because the second region 72 has a narrower width profile (and thus lower volume occupancy) compared with Method A, selective switching of the activation state of array elements that define second region 72 may be performed more rapidly to mitigate accidental withdrawal of working fluid when a user removes the fluid applicator from loading aperture 66.

Although FIG. 9 shows the second region 72 as extending through the aperture and into the port, in other embodiments the length profile of second region 72 may be shortened in towards first region 70, thus moving working fluid away from loading aperture 66.

Method F—Loading Fluid

Figure 13:
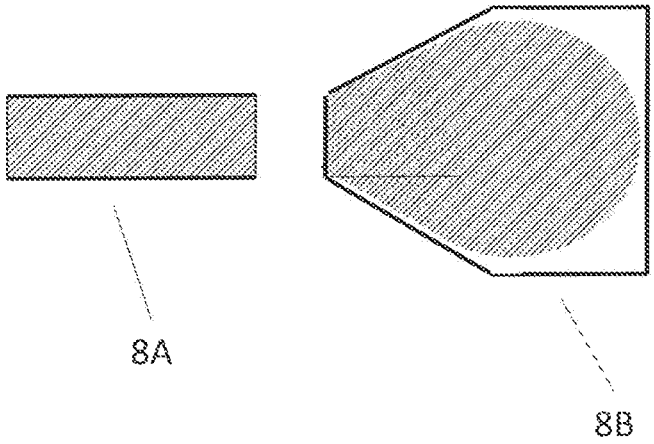
FIG. 13 illustrates a technique that may be applied in fluid loading or in fluid extraction.

In a modification of "method E" described above, a droplet split operation is performed in the second region 72 to split the introduced working fluid into two disconnected regions. In this embodiment, as working fluid is loaded into the port, only a portion of the working fluid is transmitted into the chamber and the rest remains in the port. The activation pattern of second region 72 is generally configured to bring working fluid into the chamber, avoiding contact with the spacer in the manner described above; but then a subsequent droplet split operation is performed, in which a defined volume fraction of the introduced sample is separated from the body of introduced working fluid, as shown in FIG. 13. In this figure the shaded regions again correspond to portions of the device occupied by introduced working fluid. One part 8A of the working fluid remains in connection with the fluid port and may be removed from the fluid chamber by the fluid applicator. The part 8B of the working fluid may be further manipulated, for example moved to the target region 70, by suitable actuation of the EWOD element electrodes.

Advantages of this embodiment may include one or more of:

(1) Generating a reservoir of a small volume of working fluid, which may be smaller than the minimum volume of working fluid that may be dispensed by a fluid applicator. Typically, volumes handled by a fluid applicator are at least 2 uL or more. However, for many EWOD applications microfluidic manipulation of significantly smaller volumes of fluid than 2 uL are often preferred, often of the order of nanolitres. This ability to apply such small volumes of working fluid has the benefit of minimising use of expensive or precious sample/reagents; using minimal volumes of working fluid also has the benefit of making efficient use of the fluid handling area on the electro-wetting array.

(2) Generating a reservoir of precise volume of working fluid based on capacitance sensor feedback. This embodiment is capable of controlling the volume of the reservoir created to an accuracy of a few percent, typically more accurate than the volume dispensed by the pipette. As a user introduces working fluid from the fluid applicator, sensor feedback may be used to control the dimensions of the area of working fluid and therefore control the volume of working fluid that is transferred to first region 70. Any excess working fluid that a user introduces to the device may be retained in the proximity of the port. Guidance may be provided to the user to extract any excess working fluid using the fluid applicator, in order to make more efficient use of the fluid handling area on the electro-wetting array. If an automated fluid applicator is used, the feedback from the sensor may ensure only the required volume of working fluid is dispensed in first instance, thus mitigating need to subsequently withdraw superfluous working fluid.

Method G—Fluid Extraction

Embodiments of the present disclosure have been described above with reference to loading a working fluid into an AM-EWOD device. The disclosure may further provide method of extracting working fluid from an EWOD device such as an AM-EWOD device. For example, after a reaction protocol has been run in an EWOD or AM-EWOD device, a first region 80 of the device will contain the resultant working fluid, and it may be desired to extract some or all working fluid in the region 80 from the EWOD device for analysis. A further benefit of using a narrow second region is during the process of extraction of such working fluid. The working fluid is first directed to first (target) region 80, before being directed along a narrow second region 82 towards aperture 66.

In some embodiments a fluid applicator may be introduced into a port adjacent to the aperture 66, for example when the system has issued feedback that the working fluid has been transported to the end of second region 82 in proximity to the aperture 66. On insertion of a fluid applicator into loading aperture 66, the working fluid may initially be marginally displaced due to the introduction and sealing of the fluid applicator in the port. Such displacement of working fluid is detected by the sensor and feedback may be provided to the user to indicate the fluid applicator is correctly positioned to commence working fluid extraction. The user may thus begin withdrawing working fluid with little or no filler fluid transferring to the fluid applicator, thereby reducing any downstream clean up requirements that may be required, before the processed working fluid is subjected to other processes, such as for example mass spectrometry or next generation sequencing.

Methods for extracting working fluid from the array may follow similar processes to methods of fluid loading described above, but operated in reverse order. In essence, the EWOD control means actuates elements in a second region 82 that extends wholly or partly between the first region 80 of the device containing the working fluid it is desired to extract an aperture 66 via which it is desired to extract the working fluid, so as to draw the working fluid towards the aperture. The process may for example be performed manually, by an EWOD control system applying a predetermined actuation pattern, or by an EWOD control system applying an actuation pattern based on the sensed location of working fluid within the device. Benefits of performing working fluid extraction under control of capacitance sensor feedback to ensure appropriate activation patterns are applied to the electro-wetting array, include one or more of being: able to achieve extraction of all of the working fluid; tolerant to variations in the rate of fluid extraction using a fluid applicator; and ability to ensure that minimal volume of filler fluid is extracted along with the working fluid.

Figure 11:
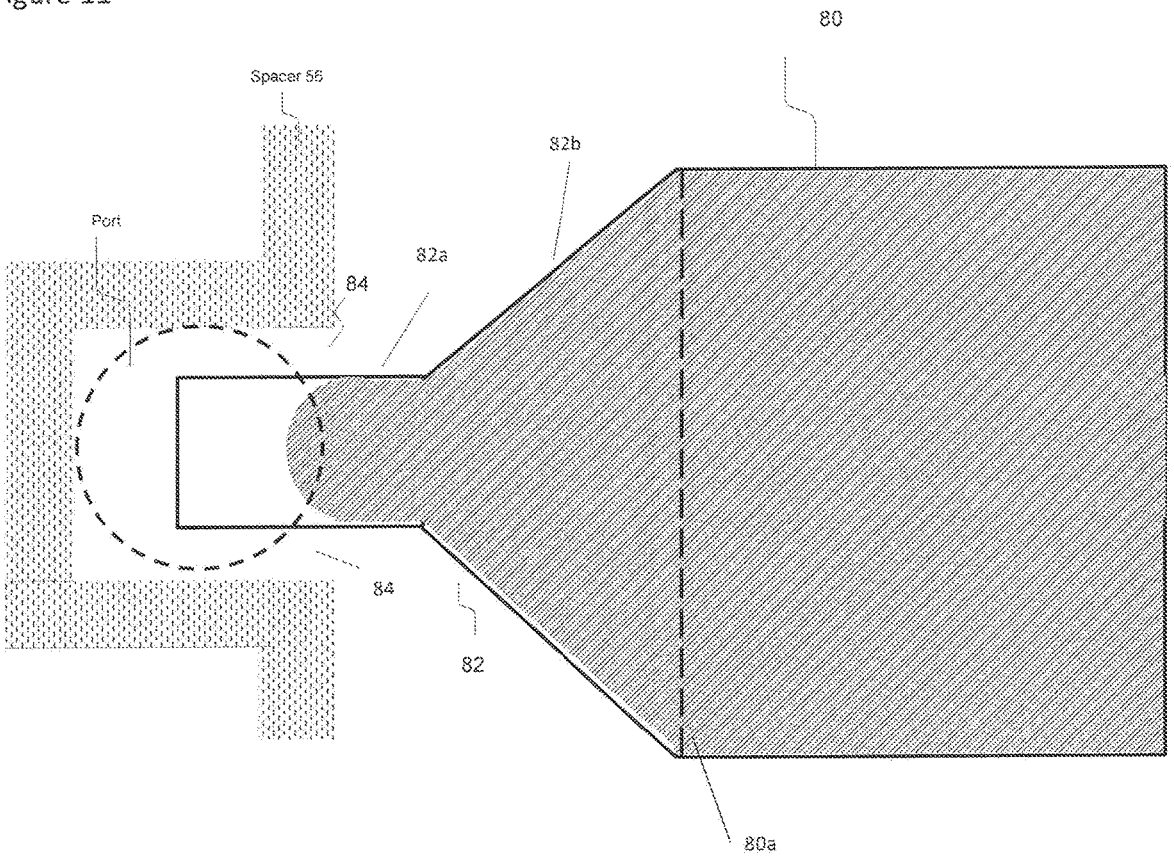
FIG. 11 is a plan view of an AM-EWOD device illustrating a method of fluid extraction.
Figure 12:
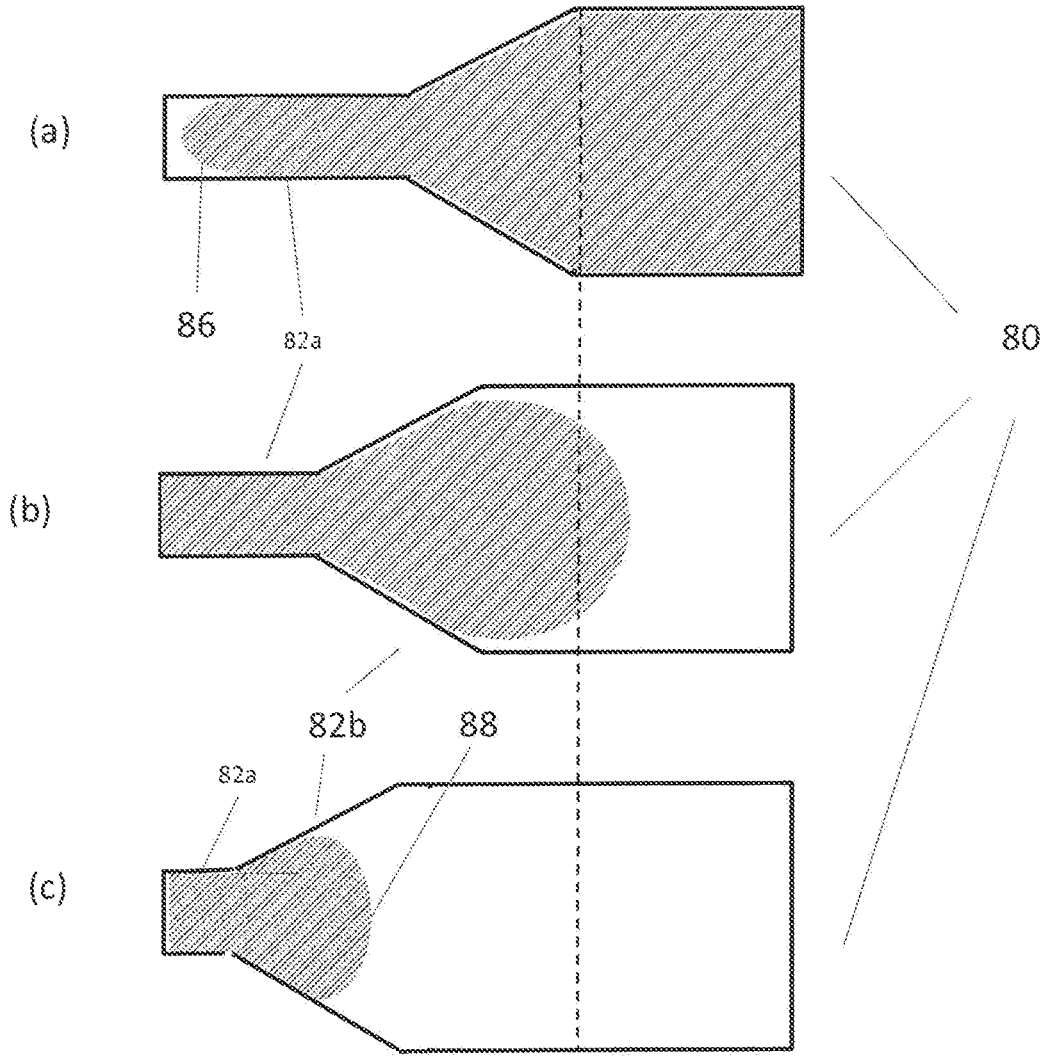
FIGS. 12(*a*), 12(*b*) and 12(*c*) are plan views of an AM-EWOD device illustrating another method of fluid loading.

Beneficial advantages of the improved methods of sample extraction from the EWOD device are described below with reference to FIGS. 11 and 12. In these figures a shaded region corresponds to the portion of the device occupied by working fluid that it is desired, at least in part, to extract. As in the above-described loading method, the region of working fluid has a width, at its nearest point to the aperture, that is less than the width of the aperture. In FIG. 11 the region of working fluid extends to and through the aperture, so that the nearest point of the second region 82 to the aperture is at the aperture, but in other embodiments the second region may not extend to the aperture. A result of the lower width of the region of working fluid is that gaps 84 are provided between the working fluid and the edges of the apertures. Advantageously and preferably, the gaps 84 are small and may be controlled (by choice of actuation pattern) to be, for example, the width of one or two array elements for each gap 84.

As noted above, beneficial aspects of the process are achieved through defined activation of regions of the electro-wetting array in order to accurately locate working fluid relative to the port through which it will be withdrawn. Typically, in comparison to the loading processes described above, the first region 80 (that is, the part of the fluid chamber that contains the working fluid to be extracted—this may also be referred to as a "reservoir") may be further away from the spacer 56 at the edge of the fluid chamber of the device than is the first region 70 in the fluid loading processes. Also, in comparison to the activation patterns applied during loading of working fluid onto the device, the second region 82 used in fluid extraction may generally have a narrower width profile than the second regions 72 used in fluid loading.

One reason for an increased distance from the reservoir 80 to the spacer, is that the initial insertion of the end of the fluid applicator into the port may transmit a mechanical force through the filler fluid that might cause the working fluid in the reservoir to become transiently displaced slightly or wobble. It is particularly desirable to ensure any such wobble does not cause the working fluid in the reservoir 80 to come into contact with the spacer. Thus, positioning the working fluid in a first region/reservoir 80 that is further away from the spacer than the first region 70 in a fluid loading process may mitigate such occurrence. Optionally, and advantageously, the mechanical insertion of the pipette into the port may be preceded by the application of an actuation pattern in the region of the reservoir, that is intended to minimise wobble on mechanical insertion by pinning (by EW actuation) the working fluid in the reservoir/first region 80.

The use of a narrower second region 82 when withdrawing working fluid from the chamber, is to facilitate the displacement of filler fluid out of the port region, back into the chamber, with the filler fluid present in the port region being replaced by the working fluid that is being extracted. In some cases it may be preferable for gaps 84 between the edge of the spacer and the second region 82 to be wider than the gaps 74 in fluid loading, to provide sufficient area for filler fluid to be displaced by working fluid approaching the port, such that the filler fluid does not disturb the integrity of the working fluid droplet (although in other cases the gaps 84 may have the same width as the gaps 74 in fluid loading, for example one or two array elements width for each gap 84). Consequently, when the fluid applicator that has been inserted into the port starts to extract working fluid, there is a reduced tendency for any filler fluid to be co-extracted with the working fluid. The consequence is that a lower volume of filler fluid gets extracted along with the working fluid. This has a number of benefits, particularly that it may minimise the negative impact that filler fluid may have on subsequent processes that working fluid may be applied to. It is feasible that, by reducing the volume of filler fluid that is extracted, subsequent clean-up steps to remove excess filler fluid from the extracted working fluid may be unnecessary.

Thus, as described above, an advantage of the capacitance sensor function for detecting fluid position facilitates closed loop feedback in operation of the device, permitting the actuation patterns applied to the electro-wetting array to be modified in real time in accordance with the position and shape of the working fluid droplet.

Thus, after the end of the fluid applicator has been inserted into the port, the EWOD control means actuates EWOD elements in a second region 82 which extends from the first region 80 towards, and preferably to, the aperture 66, and may even extend through the aperture 66 into the fluid port as shown in FIG. 11. Actuation of EWOD elements in the second region tends to draw working fluid from the reservoir region 80 towards the aperture 66 and the fluid port, as shown in FIG. 11 (the shaded region in FIG. 11 again indicates the area of the EWOD device occupied by working fluid). The EWOD control means may cease to actuate the EWOD elements in the first region when it actuates EWOD elements in the second region, to facilitate drawing the working fluid towards the aperture and port. FIG. 11 shows the device shortly after EWOD elements on the second region have been actuated, so that working fluid has started to flow into the second region but most working fluid is still in the reservoir region 80.

The broken line 80*a* in FIG. 11 denotes the boundary between the reservoir/first region 80 and the second region 82. As explained above this boundary may be considered as a notional boundary, and is defined by the actuation of array elements.

The shape of the second region 82 in FIG. 11 corresponds generally to that of the second region 72 shown in FIG. 9, in that it contains an "extraction region" 82*a* that extends through the aperture and into the port, and has, at its nearest point to the aperture, a width less than the width of the aperture. In FIG. 11 the second region extends to and through the aperture, and a result of the lower width of the second region is to leave a gap 84 at each side, and a "transition region" 82*b*, in which the width of the second region increases, between the extraction region 82 and the first region 80. In an alternative embodiment the second region could correspond to the second region 72 of FIG. 8, and have a generally uniform width that is less than the width of the first region 80 (and less than the width of the aperture). As is the case for fluid loading, in principle, the gap between the working fluid and one edge of the aperture need not be the same as the gap between the working fluid and the other edge of the aperture. Further, in principle there could be a gap only between the working fluid and one edge of the aperture with there being no gap between the working fluid and the other edge of the aperture.

In the fluid loading embodiment of FIGS. 10(*a*)-(*c*), the shape of the second region 72 in which EWOD elements are actuated is changed over time as the fluid edge 76 of the introduced working fluid moves away from the aperture into the interior of the EWOD device. FIGS. 12(*a*)-(*c*) illustrate a corresponding embodiment for fluid extraction in which the shape of the second region 82 in which EWOD elements are actuated is changed over time as the leading fluid edge 86 of the working fluid moves towards the aperture 66, so that the width of the second region 82 is changed (narrowed) behind the leading fluid edge 86 of the working fluid droplet as it is moved towards the aperture and is extracted from the chamber (in this embodiment "leading" and "behind" are with reference to the direction of movement/extraction of the working fluid (to the left in FIGS. 12(*a*)-(*c*))). FIG. 12(*a*) corresponds generally to FIG. 11, and shows the device soon after EWOD elements in the second region are actuated to start fluid extraction from the reservoir region 80. FIG. 12(*b*) shows the device at a later time, and FIG. 12(*c*) shows the device at a yet later time. To assist in comparison of the figures the boundary of the reservoir region is shown in all of FIG. 12(*a*)-12(*c*), even though all fluid has been extracted from the reservoir region in FIG. 12(*c*), and the boundary between the reservoir region and the second region 82 is shown as a broken line across all of FIGS. 12(*a*)-12(*c*).

The shape of the second region 82 in which EWOD elements are actuated is changed over time as the working fluid that is to be extracted moves towards the aperture. As can be seen, as the working fluid moves towards the aperture, the length of the extraction region 82*a* is reduced, while the transition region 82*b* increases in length and broadens to have a width equal to the width of the reservoir region. As noted above the EWOD control means may cease to actuate the EWOD elements in the reservoir region 80 when it actuates EWOD elements in the second region 82. In this method the movement of fluid is controlled by the changing contact angle at the leading fluid edge 86. As the length of the extraction region 82*a* decreases and the transition region 82*b* moves towards the aperture, this movement of the transition region 82*b* will essentially urge the working fluid into the extraction portion 82*a*, from where the negative pressure of the fluid applicator may draw the fluid out of the chamber of the device. All array elements in the second region 82 may therefore remain actuated during the fluid extraction process; alternatively, as the trailing edge of the fluid 88 moves towards the aperture, array elements behind the trailing fluid edge 88 could be put in a non-actuated state.

As with the fluid loading embodiments described, the EWOD control means may control actuation of the elements of the EWOD device based on received information about the position of working fluid in the device, or according to a pre-programmed control scheme.

During the extraction process, selective activation and deactivation of array elements in proximity of the loading aperture 66 may further improve the likelihood of working fluid be removed from the chamber with minimal filler fluid. Feedback may be provided to the user during the course of the extraction process, including, for example slow down, extraction volume removed, remove fluid applicator.

Method H—Extract Process

A further embodiment of the extraction process is similar to method G, but here a droplet split operation may be performed to split the droplet in the second region 82 into two disconnected droplets, as depicted in FIG. 13. Thus, in droplet extraction, one part 8A of the working fluid may be extracted from the EWOD device, whereas the part 8B of working fluid remains in the fluid chamber. In this aspect of withdrawing working fluid, capacitance sensor feedback may be used to control the volume of working fluid that may be withdrawn. A defined volume of working fluid may be separated off from the main working fluid droplet, for movement towards the port. When a user is operating a manual pipette device, guidance may be provided by the system to indicate when the desired volume of working fluid has been acquired. In this context, the user may be required to withdraw the fluid applicator from the port while the plunger has not been fully retracted. The user may thus be required to exert care not to fully release the plunger until the fluid applicator is completely removed from the port in order to mitigate withdrawing a potentially significant quantity of filler fluid along with the restricted volume of working fluid. When an automated fluid applicator is used, then feedback from the capacitance sensor may be used to control the volume of working fluid extracted by the fluid applicator, thereby minimising risk of contamination of the reduced volume sample of extracted working fluid with filler fluid.

This invention as described with reference to methods A to F is concerned with the safe loading of the complete volume of working fluid that resides in the fluid applicator, with respect to eliminating, or at least significantly reducing, the risk of working fluid being mistakenly withdrawn from the working area of the microfluidic device when the pipette is retracted, or to ensuring extraction of working fluid while eliminating, or at least significantly reducing, the risk of filler fluid being mistakenly extracted with the working fluid.

Although many measures can be taken to prevent working fluid being mistakenly withdrawn during fluid loading (as described above), it should easily be possible to detect whether this has happened by the use of the sensor array which is integrated into the EWOD electrode array. If (for example), the assay protocol requires 5 ul of working fluid to be loaded, but the sensor array records that only 3 ul has been loaded through some kind of user mishap (such as an incorrect volume of working fluid being loaded, or the correct volume of working fluid being loaded initially but some of the working fluid being inadvertently extracted when the fluid applicator is withdrawn), then a warning can be given to the user to add more fluid, try again or extract the 3 ul and repeat.

In a similar vein, it may be that actually the correct volume has successfully been loaded, but the position of the fluid within the microfluidic device is incorrect (this will depend on the type of software function chosen), or it has merged with a nearby droplet which has perhaps been loaded from a nearby (or the same) fluid loading well. Again, the sensor array built into the device can be utilised to alert the user that such an event has occurred, and prompt them to take appropriate action (e.g. remove the cartridge from the experiment, and start again).

Another possibility is that the droplet of working fluid finishes in the correct position, but in the process of getting there, it may have temporarily resided on an unplanned area of the device. This event is quite likely if the user is rather forceful in pushing the pipette plunger through the stop of the pipette and injects an air bubble that is rather larger than the minimum necessary to nudge the dispensed working fluid onto the desired electrodes. Even though the mal-positioning is only transient, this could present a contamination issue in the case of an assay in which areas of the EWOD array are meant to remain pristine and un-used before the introduction of a particular type of working fluid, e.g. in the case where multiple samples are to be analysed independently within the same device. Yet again, the real-time sensor information can be used to warn the user of any such risk, and thus allow the user to decide whether or not to proceed or start again from fresh.

All of the embodiments described herein could alternatively be implemented with the use of an electronic pipette that was controlled by, or in conjunction with, the EWOD control unit that controls actuation of the array elements of the EWOD microfluidic device. Such a pipette could be automated to provide exactly the right loading speeds for the phase of loading working fluid, and the extra 'push through the stop' phase could be controlled very precisely to avoid potential user errors.

In the case of manual fluid loading the warning or alert (or other output) is provided to a user and may for example be an audible and/or visual output, whereas in the case of automated or robotic fluid loading the output is provided to a control unit that is controlling the automated or robotic fluid loading, for example the EWOD control unit, and may for example be an electrical or optical signal.

For example, it would be advantageous to have the speed of formation of the air bubble controlled in order to prevent users from pushing through the stop too forcibly so that the air bubble detached from the pipette tip. If the air bubble should become detached from the pipette tip, this would mean that the air bubble was then unrecoverable before pipette retraction. An automated pipette would prevent such a mishap.

It would also be advantageous to control the amount of air injection so that the air bubble is made just large enough that the fluid contacts the electrodes. The sensor feedback from the EWOD array elements would provide information (perhaps wirelessly) to the pipette in order to control this phase of the fluid injection. Once the fluid has been put onto the electrodes as in FIG. 7(*d*), it may be safe to start retracting the air bubble and excess filler fluid during the time taken for the droplet to reach the safe zone. This will speed up the process of fluid loading.

In addition, such an intelligent pipette could also be advantageous in that it could be programmed to follow the complete loading sequence of a particular assay or protocol to be carried out on the device. It could automatically aspirate the correct volumes for the various ports. All the user would need to do is change the pipettes (or remove a disposable pipette tip from the pipette and replace it with a clean pipette tip), dunk the fresh pipette/fresh pipette tip into the correct reagent tube, and dock with the correct port.

There could also be safety features built in that detect whether the user has selected the correct port. If they have not, the pipette could automatically retract the fluid droplet back into the tip, and the software would remind the user which port they should have loaded into and to try again immediately.

The pipette could also assist with fluid extraction: the speed of aspiration could be adaptive to the shrinking volume of the droplet sensed on the device to minimise user errors.

Some of the above embodiments involve dispensing an air bubble from the pipette to force the dispensed fluid into the fluid channel of the microfluidic device. It may be that some users are uncomfortable with the concept of injecting air bubbles (albeit temporarily) into their devices. If that were to be the case, an alternative is for the user to load the fluid applicator with both filler fluid and working fluid such that the fluid dispensed after dispensing the working fluid, and following the working fluid onto the device, is filler fluid instead of air. Dispensing oil (or other filler fluid) after the working fluid works in exactly the same fashion as dispensing an air bubble, but has the advantage of not alarming a user by the sight of an air bubble on the device.

With a manual pipette, dispensing oil (or other filler fluid) after the working fluid can be achieved but may be difficult to perform. However, an intelligent pipette (as outlined above) could perform a double fluid load easily if programmed correctly.

This invention as described with reference to methods G and H is concerned with ensuring extraction of working fluid while eliminating, or at least significantly reducing, the risk of filler fluid being mistakenly extracted with the working fluid.

Some of the above embodiments involve sensing the presence and/or position of fluids within the EWOD microfluidic device, for example sensing that the fluid has reached the target region 70 in the method of FIG. 6. This may be done by controlling the EWOD array elements to operate in a sensing mode—a sensor may be configured as internal sensor circuitry incorporated as part of the drive circuitry in each array element. Such sensor circuitry may sense droplet properties by the detection of an electrical property at the array element, such as impedance or capacitance. For example, the array element circuit present in each array element may contain a droplet sensor circuit, which may be in electrical communication with the electrode of the array element. Typically, the read-out of the droplet sensor circuit may be controlled by one or more addressing lines that may be common to elements in the same row of the array, and may also have one or more outputs, e.g. OUT, which may be common to all elements in the same column of the array. The array element circuit may typically perform the functions of:

(i) Selectively actuating the element electrode by supplying a voltage to the array element electrode. Accordingly, any liquid droplet present at the array element 51 may be actuated or de-actuated by the electro-wetting effect.

(ii) Sensing the presence or absence of a liquid droplet at the location of the array element. The means of sensing may be capacitive, optical, thermal or some other means. Capacitive sensing may be employed conveniently and effectively using an impedance sensor circuit as part of the array element circuitry.

Exemplary configurations of array element circuits including impedance sensor circuitry are known in the art, and for example are described in detail in U.S. Pat. No. 8,653,832, and commonly assigned UK application GB1500261.1, both of which are incorporated here by reference. These patent documents include descriptions of how the droplet may be actuated (by means of electrowetting) and how the droplet may be sensed by capacitive or impedance sensing means. Typically, capacitive and impedance sensing may be analogue and may be performed simultaneously, or near simultaneously, at every element in the array. By processing the returned information from such a sensor, the control system described above can determine in real-time, or almost real-time the position, size, centroid and perimeter of each liquid droplet present in the microfluidic device.

Alternatively, an external sensor module may be provided for sensing droplet properties. For example, optical sensors as are known in the art may be employed as external sensors for sensing droplet properties. Suitable optical sensors include camera devices, light sensors, charged coupled devices (CCDs) and image similar image sensors, and the like.

The invention claimed is:

1. A method of loading a fluid into a microfluidic device, the microfluidic device comprising:

upper and lower spaced apart substrates defining a fluid chamber therebetween; and an aperture for receiving fluid into the fluid chamber;

the method comprising:

loading a filler fluid into the fluid chamber;

disposing a dispensing end of a fluid applicator at or near the aperture;

dispensing working fluid from the fluid applicator into a loading region adjacent the aperture and external to the fluid chamber; and forcing the working fluid from the loading region into the fluid chamber via the aperture;

wherein the microfluidic device is an active matrix electrowetting on dielectric (AM-EWOD) microfluidic device comprising a plurality of independently addressable array element electrodes, each of the plurality of independently addressable array element electrodes defining a respective array element, and each of the respective array elements defining a respective region of the fluid chamber; and wherein forcing the working fluid from the loading region into the fluid chamber comprises actuating at least one of the array elements of the microfluidic device to draw the dispensed working fluid into the fluid chamber of the microfluidic device.

2. A method as claimed in claim 1, and comprising actuating at least one array element in a second region of the microfluidic device, the second region being between the aperture and a target region of the microfluidic device for the working fluid.

3. A method as claim in claim 2, wherein the second region of the microfluidic device has, at its nearest point to the aperture, a width less than a width of the aperture.

4. A method as claimed in claim 3, wherein the second region comprises a first part having a width less than the width of the aperture and a second part having a second, greater width, a boundary between the first part and the second part being between the aperture and a flow edge of working fluid.

5. A method as claimed in claim 4, and comprising applying a time varying actuation pattern, so that the boundary between the first part and the second part moves away from the aperture as the flow edge of working fluid moves away from the aperture.

6. A method as claimed in claim 2, further comprising actuating the second group of array elements after detecting working fluid in the second region of the fluid chamber.

7. A method as claimed in claim 2, further comprising actuating array elements such that the second region of the fluid chamber matches the region of the fluid chamber occupied by the working fluid.

8. A method as claimed in claim 1, further comprising actuating a target group of array elements of the microfluidic device, the target group of the array elements corresponding to a target region of the fluid chamber, to move working fluid introduced via the aperture to the target region of the fluid chamber.

9. A method as claimed in claim 8, comprising actuating the target group of array elements upon determining that the region of the fluid chamber occupied by the working fluid has reached a predetermined size and/or upon determining that the rate of change of size of the region of the fluid chamber occupied by the working fluid is below a predetermined threshold.

10. A method as claimed in claim 4, further comprising:

determining that working fluid has been introduced into a region of the fluid chamber; and providing an output to indicate that the working fluid is present in the region.

11. A method as claimed in claim 1 and comprising controlling a pattern of actuated array elements based on a sensed position of fluid in the microfluidic device.

12. A method as defined in claim 1 and comprising controlling a pattern of actuated array elements to split the working fluid into two portions.

* * * * *